US009398384B2

(12) United States Patent
Harte et al.

(10) Patent No.: US 9,398,384 B2
(45) Date of Patent: Jul. 19, 2016

(54) HEARING PROSTHESIS ACCESSORY

(71) Applicant: Cochlear Limited, Macquarie University, NSW (AU)

(72) Inventors: David Harte, Erskenville (AU); Taduesz Jurkiewicz, Rozelle (AU); Slobodan Ilic, Chatswood (AU); Hans Yoo, Ryde (AU)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 14/546,030

(22) Filed: Nov. 18, 2014

(65) Prior Publication Data

US 2015/0163607 A1 Jun. 11, 2015

Related U.S. Application Data

(60) Provisional application No. 61/914,468, filed on Dec. 11, 2013.

(51) Int. Cl.
*H04R 25/00* (2006.01)

(52) U.S. Cl.
CPC ..... *H04R 25/65* (2013.01); *H04R 25/60* (2013.01); *H04R 25/658* (2013.01); *H04R 2225/021* (2013.01); *H04R 2225/63* (2013.01)

(58) Field of Classification Search
CPC ..... H04R 25/60; H04R 25/65; H04R 25/658; H04R 2225/021; H04R 2225/025; H04R 2225/49; H04R 2225/63
USPC ..... 381/322, 324, 327, 328, 330, 381; 181/129, 130, 135
See application file for complete search history.

(56) References Cited

U.S. PATENT DOCUMENTS

| | | | | |
|---|---|---|---|---|
| 3,906,170 | A * | 9/1975 | Guice | H04R 25/65 381/322 |
| 6,510,230 | B2 * | 1/2003 | Marx | H04R 25/65 381/189 |
| 8,180,083 | B2 | 5/2012 | Campbell et al. | |
| 8,437,860 | B1 | 5/2013 | Crawford et al. | |
| 2011/0002493 | A1 * | 1/2011 | Campbell | H04R 25/65 381/330 |

FOREIGN PATENT DOCUMENTS

| | | | |
|---|---|---|---|
| DE | 102010041263 | A1 | 3/2012 |
| WO | 2012082320 | A2 | 6/2012 |
| WO | 2012083202 | A1 | 6/2012 |

* cited by examiner

*Primary Examiner* — Huyen D Le
(74) *Attorney, Agent, or Firm* — Edell, Shapiro & Finnan, LLC

(57) ABSTRACT

Embodiments presented herein are generally directed to a protective sleeve for an external component of a hearing prosthesis. The protective sleeve comprises a base plug configured to be inserted into a main body. The main body and base plug are each primarily formed from a substantially flexible material and each comprises one or more substantially rigid members. When the base plug is inserted into the main body the substantially rigid members operate to deform a portion of substantially flexible material forming part of the main body or base plug to seal the base plug to the main body.

19 Claims, 27 Drawing Sheets

HEARING PROSTHESIS ACCESSORY

CROSS-REFERENCE TO RELATED APPLICATIONS

This application claims priority to U.S. Provisional Application No. 61/914,468 entitled "Hearing Prosthesis Accessory," filed Dec. 11, 2013, the content of which is hereby incorporated by reference herein.

BACKGROUND

1. Field of the Invention

The present invention relates generally to hearing prostheses, and more particularly, to a hearing prosthesis accessory.

2. Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

In many people who are profoundly deaf, however, the reason for their deafness is sensorineural hearing loss. Those suffering from some forms of sensorineural hearing loss are unable to derive suitable benefit from auditory prostheses that generate mechanical motion of the cochlea fluid. Such individuals can benefit from implantable auditory prostheses that stimulate nerve cells of the recipient's auditory system in other ways (e.g., electrical, optical and the like). Cochlear implants are often proposed when the sensorineural hearing loss is due to the absence or destruction of the cochlea hair cells, which transduce acoustic signals into nerve impulses. Auditory brainstem stimulators might also be proposed when a recipient experiences sensorineural hearing loss due to damage to the auditory nerve.

SUMMARY

In one aspect presented herein, a protective sleeve for a hearing prosthesis sound processor is provided. The protective sleeve comprises a shell formed from a substantially flexible material, a plug port in the shell that is surrounded by a portion of the substantially flexible material, and a substantially rigid port ring that is disposed around the portion of the substantially flexible material. When a plug is inserted into the plug port, the port ring operates with the plug to deform the portion of the substantially flexible material surrounding the plug port to seal the plug in the shell.

In another aspect presented herein, a protective sleeve for a behind-the-ear sound processor of a hearing prosthesis is provided. The protective sleeve comprises a main body formed from a substantially flexible material having a base opening configured to receive the behind-the-ear sound processor, a substantially rigid ear hook that is integrated with the main body, and a base plug formed from the substantially flexible material and configured to be inserted into the base opening to seal the behind-the-ear sound processor in the main body.

In another aspect presented herein, a protective sleeve for a hearing prosthesis sound processor is provided. The protective sleeve comprises a substantially flexible main body having a base opening and integrated with a rigid base ring disposed around the base opening and a substantially flexible base plug integrated with a rigid plug ring and configured to be inserted into the base opening. When the base plug is inserted into the base opening, the rigid plug ring operates with the rigid base ring to compress one or more of the main body or base plug to seal the sound processor in the protective sleeve.

BRIEF DESCRIPTION OF THE DRAWINGS

Embodiments of the present invention are described herein in conjunction with the accompanying drawings, in which.

DETAILED DESCRIPTION

Embodiments presented herein are generally directed to a protective sleeve or case for an external component of a hearing prosthesis. The protective sleeve comprises a base plug configured to be inserted into a main body. The main body and base plug are each primarily formed from a substantially flexible material and each comprises one or more substantially rigid members. When the base plug is inserted into the main body the substantially rigid members operate to deform a portion of substantially flexible material forming part of the main body or base plug to seal the base plug to the body.

In certain embodiments, the main body includes a plug port that is surrounded by a portion of the substantially flexible material. Additionally, a substantially rigid member is disposed around the portion of the substantially flexible material. When a rigid plug (e.g., cable plug, electrical connector plug, acoustic tube plug, etc.) is inserted into the plug port, the substantially rigid member operates with the plug to deform the portion of the substantially flexible material surrounding the plug port to seal the plug in the main body.

For ease of illustration, the protective sleeve is primarily described with reference to use with a behind-the-ear (BTE) sound processor of a cochlear implant (also commonly referred to as cochlear implant device, cochlear prosthesis, and the like; simply "cochlear implant" herein). It is to be appreciated that protective sleeves in accordance with embodiments presented herein may be used with other external sound processors (e.g., button processors), external coils, and external components of other hearing prostheses (e.g., bone conduction devices, auditory brain stimulators, mechanical stimulators, acoustic hearing aids, hybrid hearing devices, etc.).

Figure 1A:
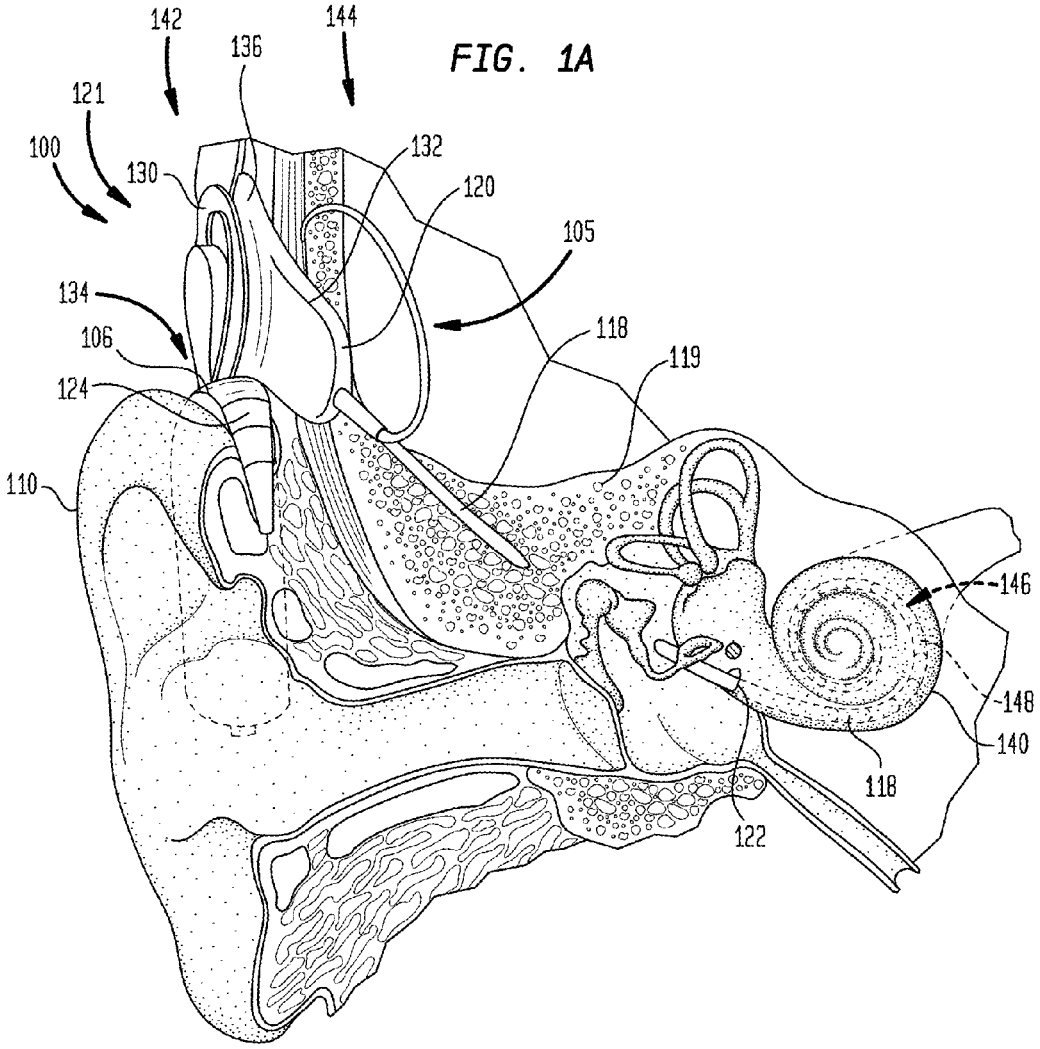
FIG. 1A is a schematic diagram of a cochlear implant for use with a protective sleeve in accordance with embodiments presented herein.

FIG. 1A is perspective view of an exemplary cochlear implant 100 with which a protective sleeve (not shown in FIG. 1A) in accordance with embodiments presented herein may be used. The cochlear implant 100 includes an external component 142 and an internal or implantable component 144. The external component 142 comprises a behind-the-ear sound processor 134 that is detachably connected to an ear hook 124. The ear hook 124 is configured to attach the behind-the-ear sound processor 134 to the recipient's ear. That is, while in use, the ear hook 124 hangs on the top of the recipient's outer ear (e.g., on the auricle 110) such that the sound processor 134 lies substantially behind the recipient's outer ear. The sound processor 134 is also electrically connected to an external coil assembly 121.

Figure 1B:
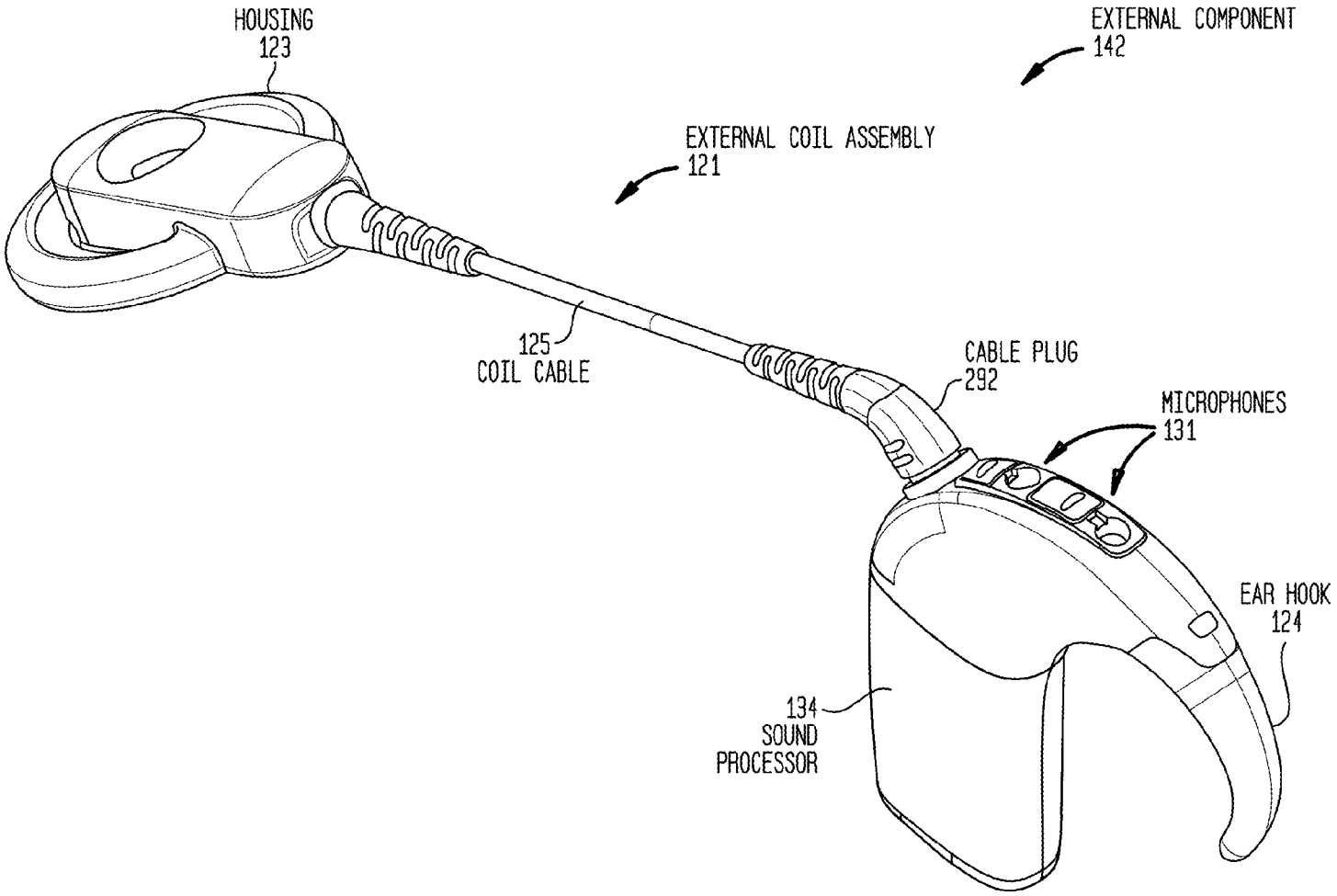
FIG. 1B is a perspective view of the external component of the cochlear implant of FIG. 1A.
Figure 1C:
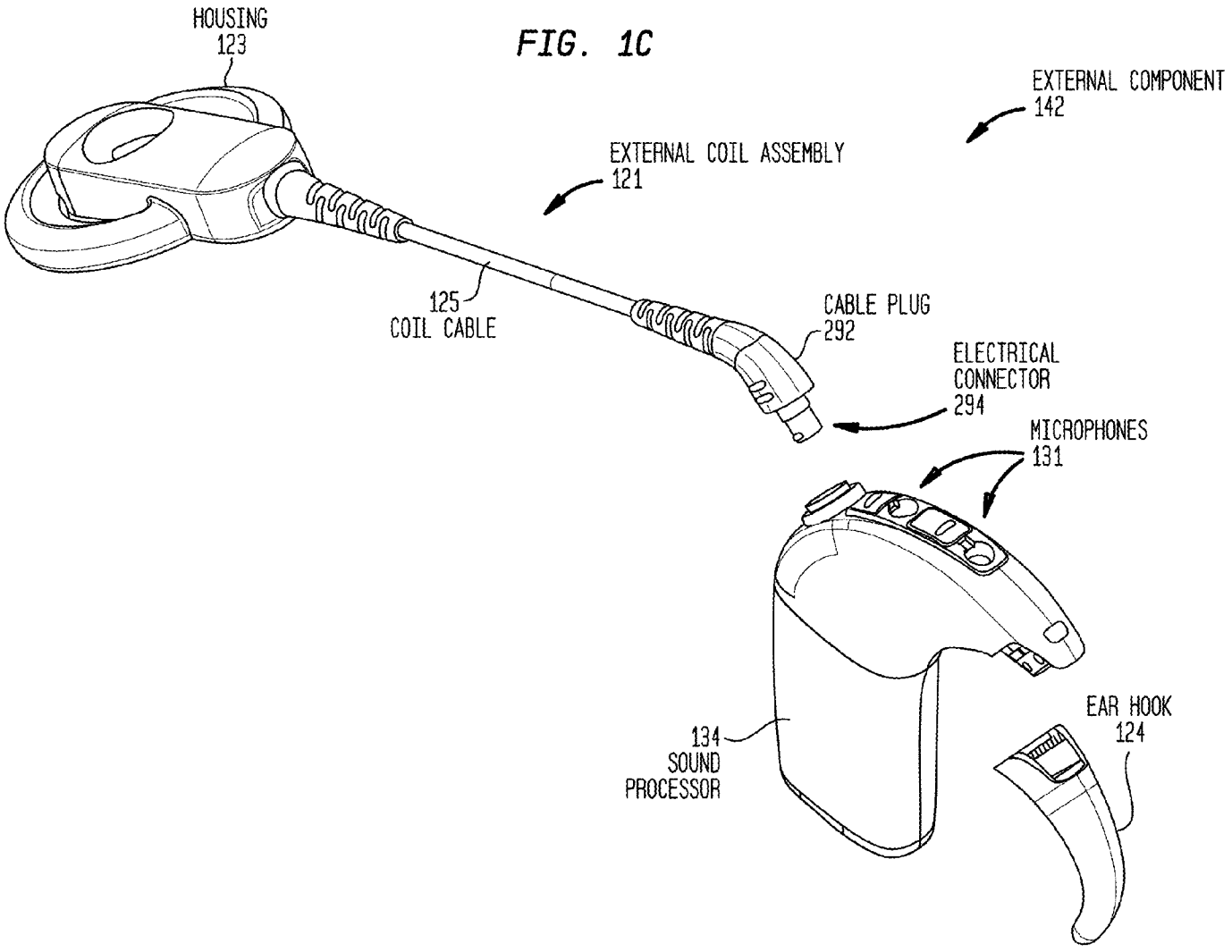
FIG. 1C is a perspective view of the external component of the cochlear implant of FIG. 1A were the behind-the-ear sound processor is separated from the external coil assembly and the ear hook.

FIG. 1B is a perspective view of the external component 142 that illustrates connection of the ear hook 124 and the external coil assembly 121 to the sound processor 134. FIG. 1C is another perspective view of the external component 142 that shows the ear hook 124 and the external coil assembly 121 disconnected from the sound processor 134.

The behind-the-ear sound processor 134 includes a substantially hard housing 106. One or more sound input elements, such as microphones 131 (FIGS. 1B and 1C), telecoils, etc. for detecting sound are disposed in (or on) the housing 106. A power source (not shown in FIGS. 1A-1C) and sound processing elements (also not shown in FIGS. 1A-1C) are also disposed in the housing 106. The sound processing elements process electrical signals generated by the sound input element(s) and provide the processed signals to an external coil 130 in the external coil assembly 121.

As shown in FIGS. 1B and 1C, the external coil assembly 121 comprises a housing 123 in which the external coil 130 is disposed. Extending from the housing 123 is a coil cable 125 that terminates in a cable plug 292. The cable plug 292 includes an electrical connector 294 that electrically connects to an electrical connector (not shown) of the behind-the-ear sound processor 134. In one embodiment, the cable plug 292 includes a male connector 294 that mates with a female receptacle (not shown in FIG. 1B or 1C) of the behind-the-ear sound processor 134.

In operation, the electrical signals from the sound processing elements of sound processor 134 are provided to coil 130 via the coil cable 125. The external coil 130 is generally co-located with a magnet (not shown in FIGS. 1A-1C) fixed relative to the external coil 130.

The implantable component 144 comprises an implant body 105, a lead region 108, and an elongate stimulating assembly 118. The implant body 105 comprises a stimulator unit 120, an internal coil 136, and an internal receiver/transceiver unit 132, sometimes referred to herein as transceiver unit 132. The transceiver unit 132 is connected to the internal coil 136 and, generally, a magnet (not shown in FIG. 1) fixed relative to the internal coil 136. Internal transceiver unit 132 and stimulator unit 120 are sometimes collectively referred to herein as a stimulator/transceiver unit 120.

The magnets in the external component 142 and implantable component 144 facilitate the operational alignment of the external coil 130 with the internal coil 136. The operational alignment of the coils enables the internal coil 136 to transmit/receive power and data to/from the external coil 130. More specifically, in certain examples, external coil 130 transmits electrical signals (e.g., power and stimulation data) to internal coil 136 via a radio frequency (RF) link. Internal coil 136 is typically a wire antenna coil comprised of multiple turns of electrically insulated single-strand or multi-strand platinum or gold wire. The electrical insulation of internal coil 136 is provided by a flexible silicone molding. In use, transceiver unit 132 may be positioned in a recess of the temporal bone of the recipient. Various other types of energy transfer, such as infrared (IR), electromagnetic, capacitive and inductive transfer, may be used to transfer the power and/or data from an external device to cochlear implant and FIG. 1 illustrates only one example arrangement.

Elongate stimulating assembly 118 is at least partially implanted in cochlea 140 and includes a contact array 146 comprising a plurality of stimulating contacts 148. The stimulating contacts 148 may comprise electrical contacts and/or optical contacts. Stimulating assembly 118 extends through cochleostomy 122 and has a proximal end connected to stimulator unit 120 via lead region 108 that extends through mastoid bone 119. Lead region 108 couples the stimulating assembly 118 to implant body 105 and, more particularly, stimulator/transceiver unit 120.

As noted above, the behind-the-ear sound processor 134 processes the electrical signals received at the sound input elements and these signals are provided to the implantable component 144 (via the coil 130). As such, the behind-the-ear sound processor 134 must be worn (and operational) in order for the recipient to hear sounds. However, a hearing prosthesis recipient may encounter wet, humid, dusty, or other environments that could potentially damage the sound input elements, sound processing elements, power source, etc. in the behind-the-ear sound processor 134. Traditionally, in such situations a recipient has been forced to either remove the behind-the-ear sound processor 134 before entering the potentially damaging environment or to rely on the housing 106, or another hard covering, to protect the electrical components from ingress of water, dust, etc. Both of these options are unsatisfactory and potentially create safety issues. In particular, as noted, removal of the behind-the-ear sound processor 134 eliminates the recipient's ability to hear warnings, instructions, etc. Additionally, housing 106 (and other conventional hard sound processing housings) are not manufactured so as to prevent the total ingress of fluids, dust, and other contaminants. This creates a potential danger to the recipient if the electrical components within the behind-the-ear sound processor 134 are short-circuited or otherwise damaged.

Figure 2A:
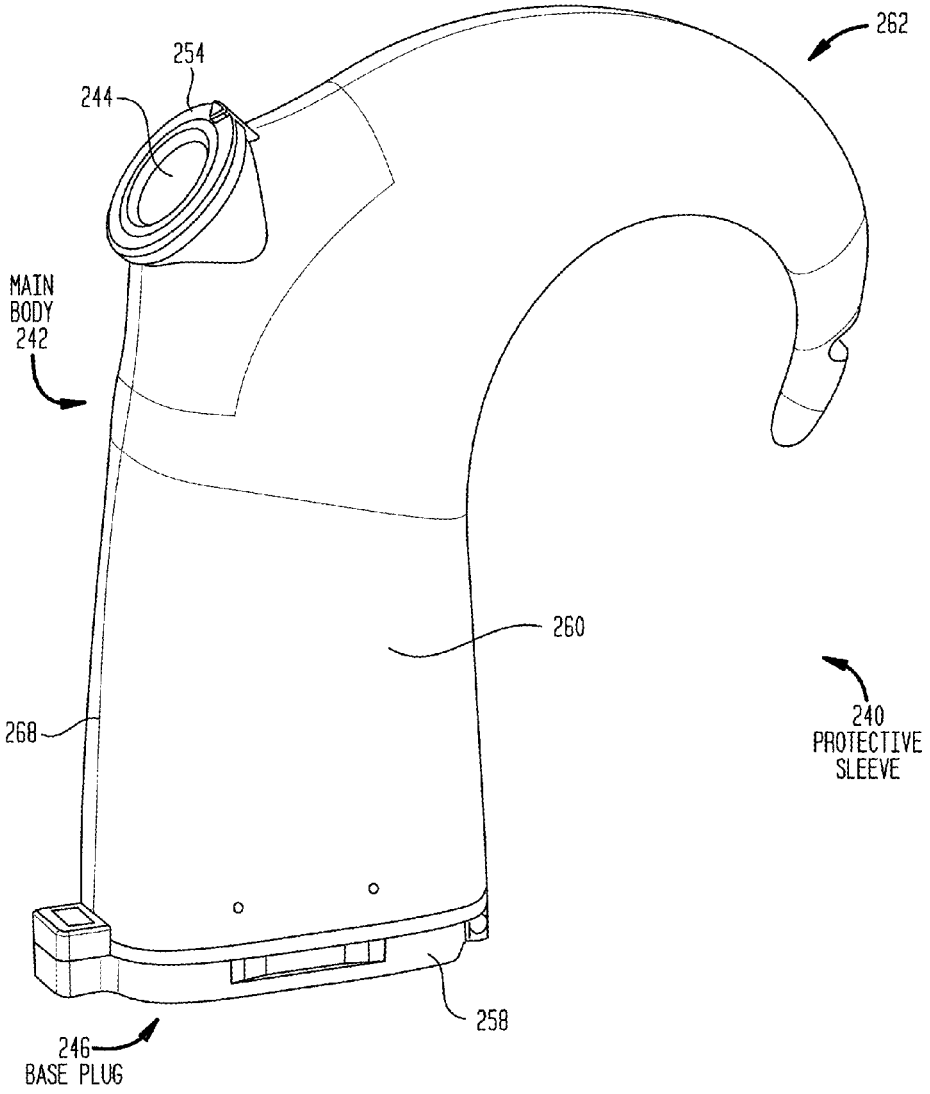
FIG. 2A is a perspective view of a protective sleeve in accordance with embodiments presented herein.
Figure 2B:
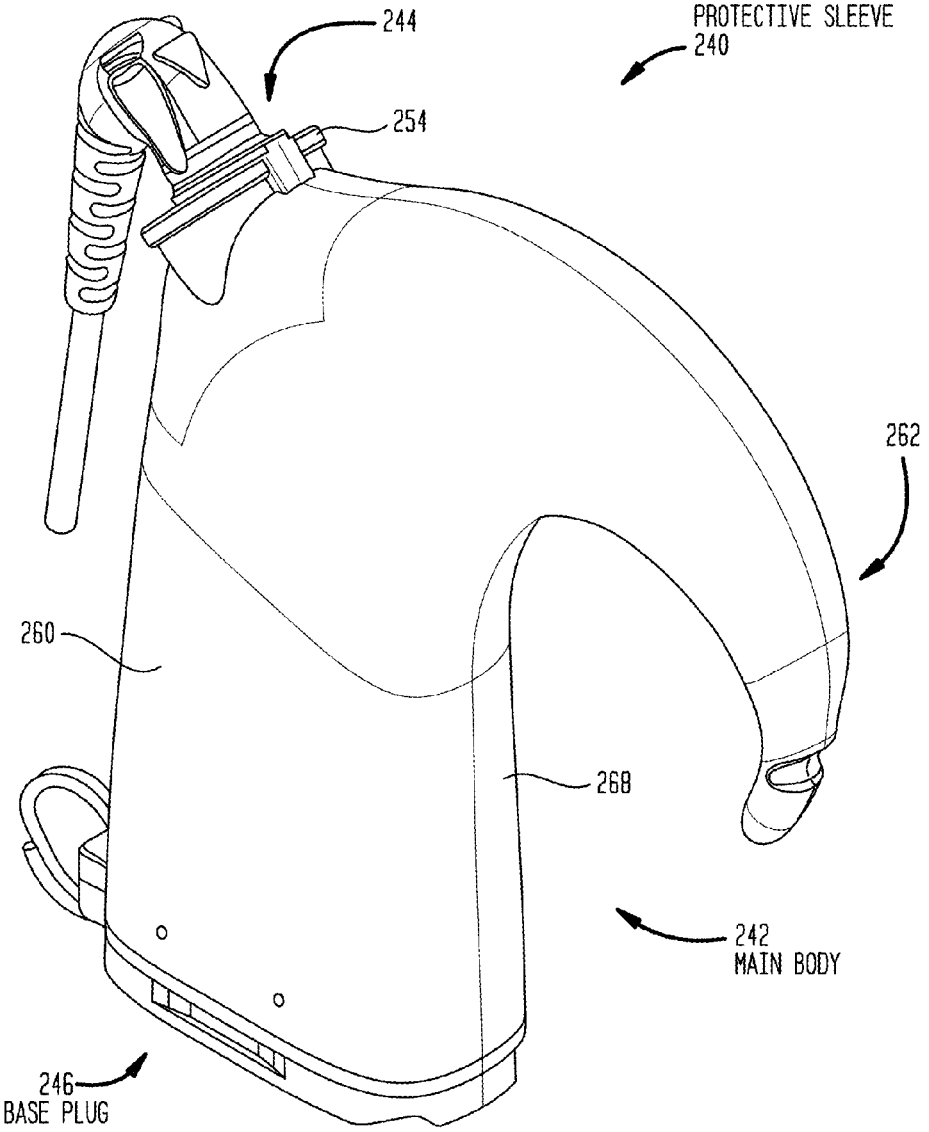
FIG. 2B is a perspective view of a behind-the-ear sound processor positioned in a protective sleeve in accordance with embodiments presented herein.

FIG. 2A is a perspective view of a protective sleeve 240 in accordance with embodiments presented herein that is configured for use with the behind-the-ear sound processor 134. FIG. 2B is a perspective view of the protective sleeve 240 when the behind-the-ear sound processor 134 is positioned in the sleeve.

The protective sleeve 240 is primarily formed from a substantially flexible material that is form fitting to the behind-the-ear sound processor 134. The substantially flexible material is integrated with discrete rigid members. The rigid members interact with one another and the flexible material to substantially prevent the ingress of water, dust, and other contaminants that could potentially damage the electrical elements of the sound processor 134. Protective sleeve 240 is also configured to enable the behind-the-ear sound processor 134 to continue operation while the sound processor is positioned in the protective sleeve.

As shown in FIG. 2A, the protective sleeve 240 comprises a main body 242 that includes a base opening (not shown in FIG. 2A) and a plug port 244. In the embodiments of FIGS. 2A and 2B, the base opening is substantially closed by a base plug 246. That is, the protective sleeve 240 comprises a base plug 246 that is configured to mate with the main body 242 to seal the base opening. The main body 242 and base plug 246 collectively form a flexible shell.

Figure 3:
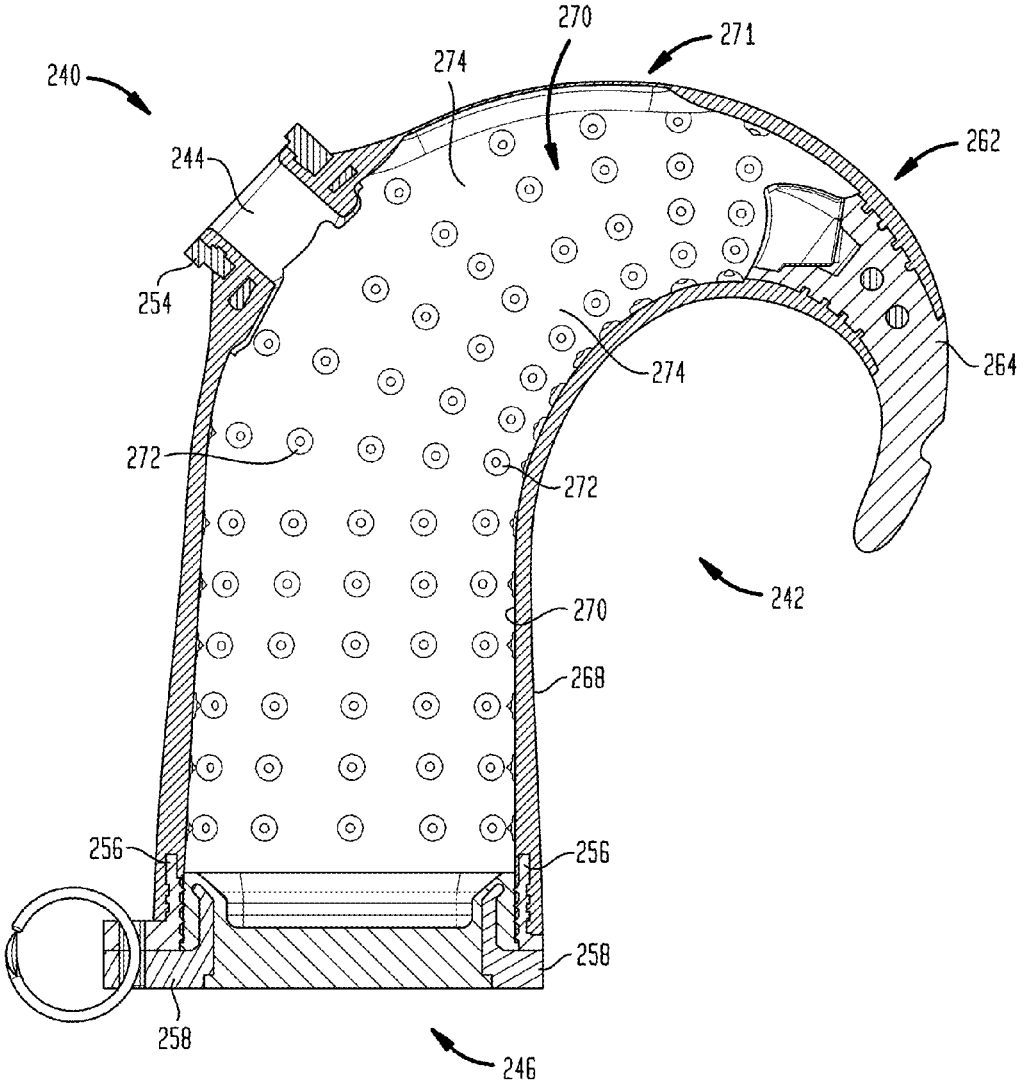
FIG. 3 is a cross-sectional view of a protective sleeve in accordance with embodiments presented herein.

The main body 242 includes an elongate first section 260 that, as shown in FIG. 2B is shaped to receive the behind-the-ear sound processor 134. The first section 260 has one end that terminates in the base opening through which the behind-the-ear sound processor 134 is inserted. As described further below, the main body 242 also includes a second section 262 that that has a general hook or curved shape in which a rigid ear hook 264 is positioned. The ear hook 264 is disposed in the main body 242 and, as such, is not visible in FIG. 2A or 2B. However, the ear hook 264 is shown in FIG. 3.

The main body 242 and base plug 246 are primarily formed from a substantially flexible and contaminant-proof (e.g., waterproof, dust proof, etc.) material. In certain embodiments, the substantially flexible material is a soft silicone material referred to herein as Liquid Silicone Rubber (LSR). LSR provides a soft, stretchy and flexible outer shell that can withstand significant abuse. As described further below, the substantially flexible material comprises the overall shell for the protective sleeve 240, but also operates as the sealing elements. In other words, the contaminant proof seals of the protective sleeve 240 are formed by the flexible material reinforced with rigid (e.g., hard plastic) members.

The material used to form main body 242 and base plug 246 may have a Shore A hardness of approximately 40 (40 Shore A). It is appreciated that other similar materials and hardness (e.g., in the range between Shore 20A and 60A) may be used in alternative embodiments. As used herein, hardness refers to a material's resistance to indentation.

The main body 242 is integrated with (e.g., molded over and/or around) a plurality of substantially rigid members 254,256, and 264. Similarly, the base plug 246 is integrated with a substantially rigid member 258. The rigid member 256 is disposed in the main body 242 and, as such, is not visible in FIG. 2A or 2B. However, the rigid member 256 is shown in FIG. 3.

As described further below, the substantially rigid members 254, 256, and 258 interact with the flexible material of the main body 242 and/or base plug 246 to seal the behind-the-ear sound processor 134 in the sleeve in a manner that prevents the ingress of water, dust, and other contaminants that could potentially damage the electrical elements of the behind-the-ear sound processor 134.

The material forming the rigid members 254, 256, 258, and 264 is substantially harder than the flexible material forming the main body 242 and base plug 246. For example, in certain embodiments the rigid members 254, 256, 258, and 264 have a Shore D hardness of 80. It is appreciated that other similar materials and hardness (e.g., in the range between Rockwell R 50 and Rockwell R 120) may be used in alternative embodiments.

In certain embodiments, the main body 242, base plug 246, rigid member 254, rigid member 256, and rigid member 264 may be formed from substantially clear (transparent) materials, while the rigid member 258 is formed from an opaque rigid material. In other embodiments, main body 242 and base plug 246 may be formed from a substantially clear flexible material, while the rigid members 254, 256, 258, and 264 are formed from opaque rigid materials. It is to be appreciated that other combinations of clear, opaque, or other colors are also possible in different embodiments.

The main body 242 is configured to be substantially form (close) fitting to the behind-the-ear sound processor 134. The close fitting between the main body 242 and the behind-the-ear sound processor 134 may be considered aesthetically pleasing since it adds minimal bulk to the behind-the-ear sound processor 134, thereby improving retention and reducing irritation for the receipt, as compared to traditional arrangements. Furthermore, since the protective sleeve 240 is as streamlined as possible, there is minimal surface area for water or other contaminants to strike while, for example, swimming. This minimal surface area improves retention during such activities.

In certain embodiments, the exterior/outer surface 268 of the main body 242 is designed to have a polished finish. The polished finished improves the clarity and transparency of the flexible material so that a recipient or other user can see through to the inside of the protective sleeve 240. Additionally, a high polish finish results in an exterior surface 268 that, relative to an unpolished surface, is relatively easier for a recipient or other user to grip. An exterior surface 268 that is easy to grip makes it easier for the recipient to handle the protective sleeve 240 during installation and removal of the behind-the-ear sound processor 134, as well as during general use. In further embodiments, a polished finish on the outer surface 268 may result in a product that has increased friction with the recipient's skin, thereby creating a "sticking" effect that results in improved retention of the protective sleeve 240 and the behind-the-ear sound processor 134 when worn by a recipient.

FIG. 3 is a cross-sectional view of the protective sleeve 240 that illustrates an inner surface 270 of the main body 242. As shown, the inner surface 270 of the main body 242 has a plurality of protruding dimples 272 and areas 274 between the dimples. The dimples 272 and/or the areas 274 of the inner surface 270 between the dimples 272 are textured/roughened surfaces. For example, the dimples 272 and areas 274 may be textured to a specific electrical discharge machining (EDM) finish. In one specific example, the dimples 272 and areas 274 have an EDM finish of VDI CH 36. In operation, the textured surface areas 274 and the dimples 272 make it easier to install and remove the behind-the-ear sound processor 134. Without these features, the behind-the-ear sound processor 134 would be very difficult to install and remove, due to the form fitting shape/design and the inherent "stickiness" of the flexible material forming main body 242. The dimples 272 may also provide an aesthetic benefit, giving the appearance of water droplets when viewed from the outside of the protective sleeve 240.

Figure 4:
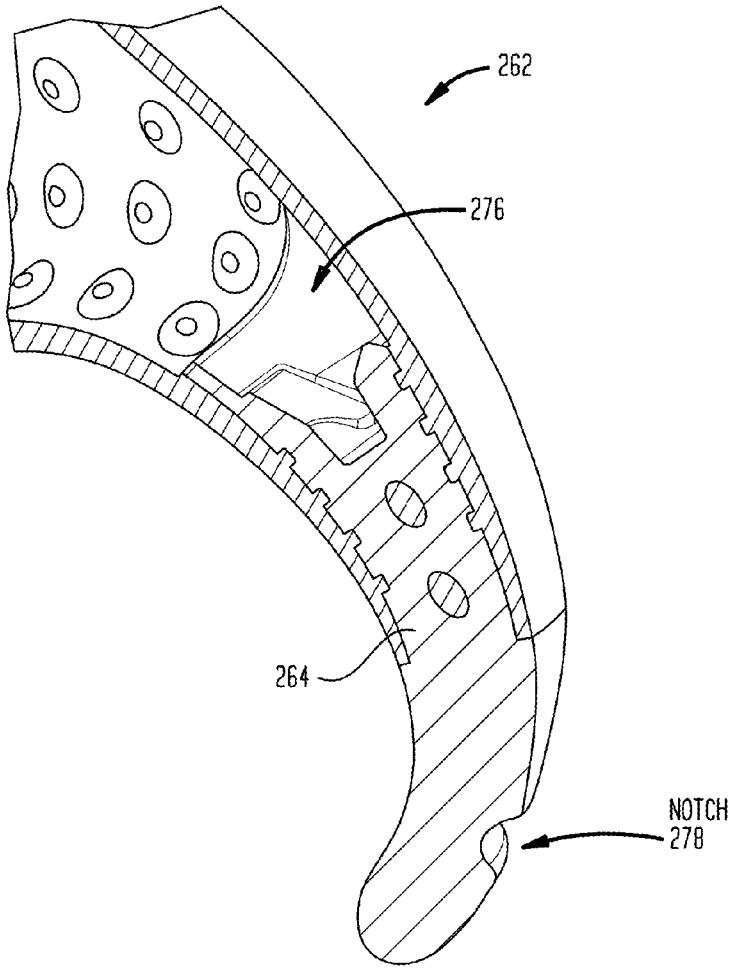
FIG. 4 is a cross-sectional view of a section of a protective sleeve in accordance with embodiments presented herein.

As noted above, main body 242 includes a section 262 in which a rigid member 264, referred to as an ear hook 264 is positioned. FIG. 4 is a cross-sectional view of section 262 and ear hook 264. The ear hook 264 is integrated with the main body 242. More specifically, the main body 242 is molded around the ear hook 264 such that, at least in one embodiment, the ear hook is permanently disposed in the section 262.

The rigid ear hook 264 performs a number of functions. First, the ear hook 264 replaces the ear hook 124 (FIG. 1) that is attached to behind-the-ear sound processor 134 when used without the protective sleeve 240. This simplifies installation/removal of the behind-the-ear sound processor 134 since there is no need to also force the ear hook 124 through section 260 and into section 262. Second, the rigid ear hook 264 provides structural support to the protective sleeve 240. In particular, the structural support provided by the ear hook 264 makes the protective sleeve 240 easier to handle and also retains the upper portion 271 of the protective sleeve 240 in an open arrangement. The open arrangement of upper portion 271 makes it easier to install the behind-the-ear sound processor 134 into the section 260. Finally, the rigid ear hook 264 provides the mechanism by which the protective sleeve 240 and the behind-the-ear sound processor 134 are retained on the recipient's ear.

The ear hook 264 may also include a connector 276. In certain embodiments, the connector 276 may be configured to mechanically couple to a corresponding connector on the behind-the-ear sound processor 134. However, it is to be appreciated that mechanical coupling between the ear hook 264 and behind-the-ear sound processor 134 is not necessary.

Figure 5:
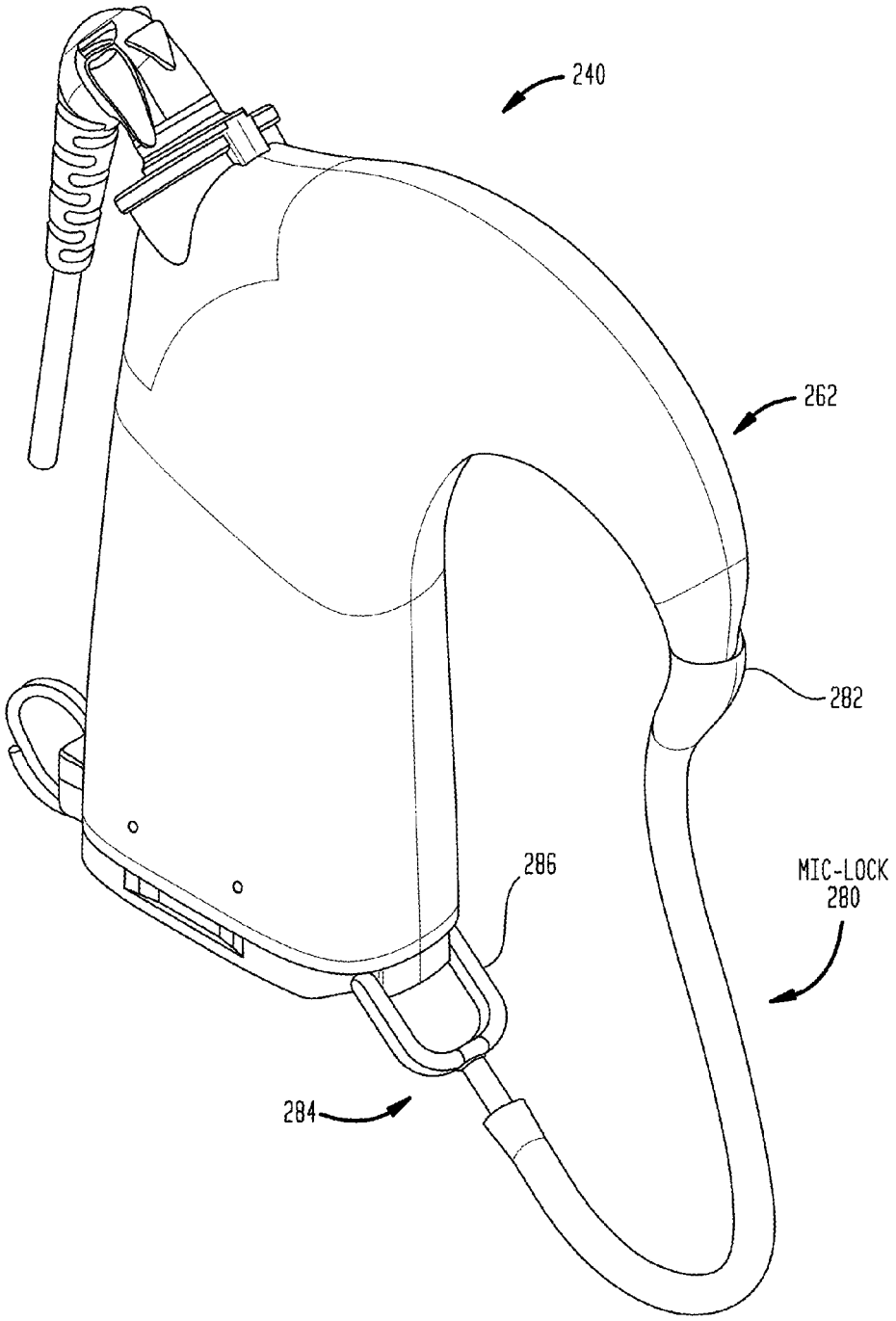
FIG. 5 is a perspective view of a mic-lock used with a protective sleeve in accordance with embodiments presented herein.

As shown in FIG. 4, an outer surface of section 262 includes a notch 278. The notch 278 is configured to provide an anchor point for a mic-lock. More specifically, FIG. 5 is a perspective view of the protective sleeve 240 shown with an example mic-lock 280. The mic-lock 280 is, in general, a tube having a first end 282 that extends around the end of section 262. The notch 278 serves to secure the first end 282 to the section 262. In general, a portion of first end 282 is disposed in the notch 278 so as to interlock with the section 262.

The mic-lock 280 includes a stirrup connector 286 disposed at a second end 284 of the mic-lock. The stirrup connector 286 may extend from, or be detachably connected to, the base plug 246.

Figure 6A:
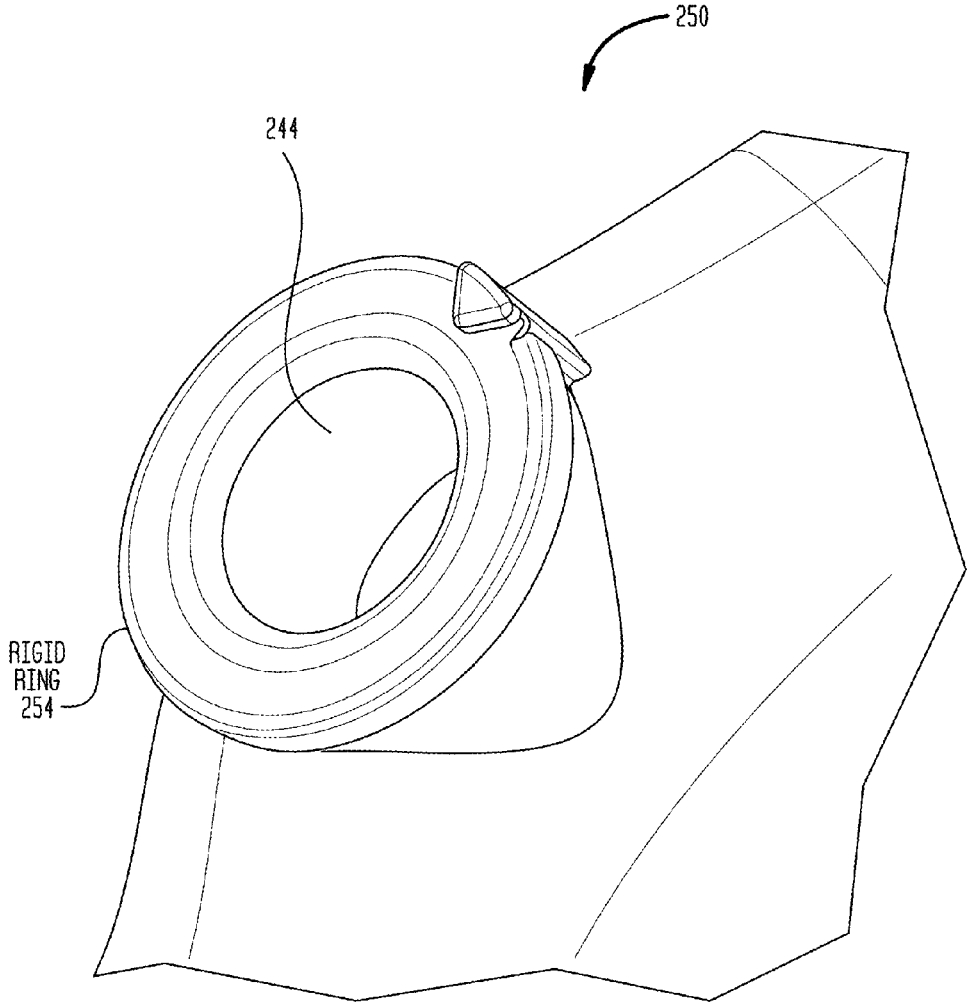
FIG. 6A is a perspective view of a plug port area of a protective sleeve in accordance with embodiments presented herein.
Figure 6B:
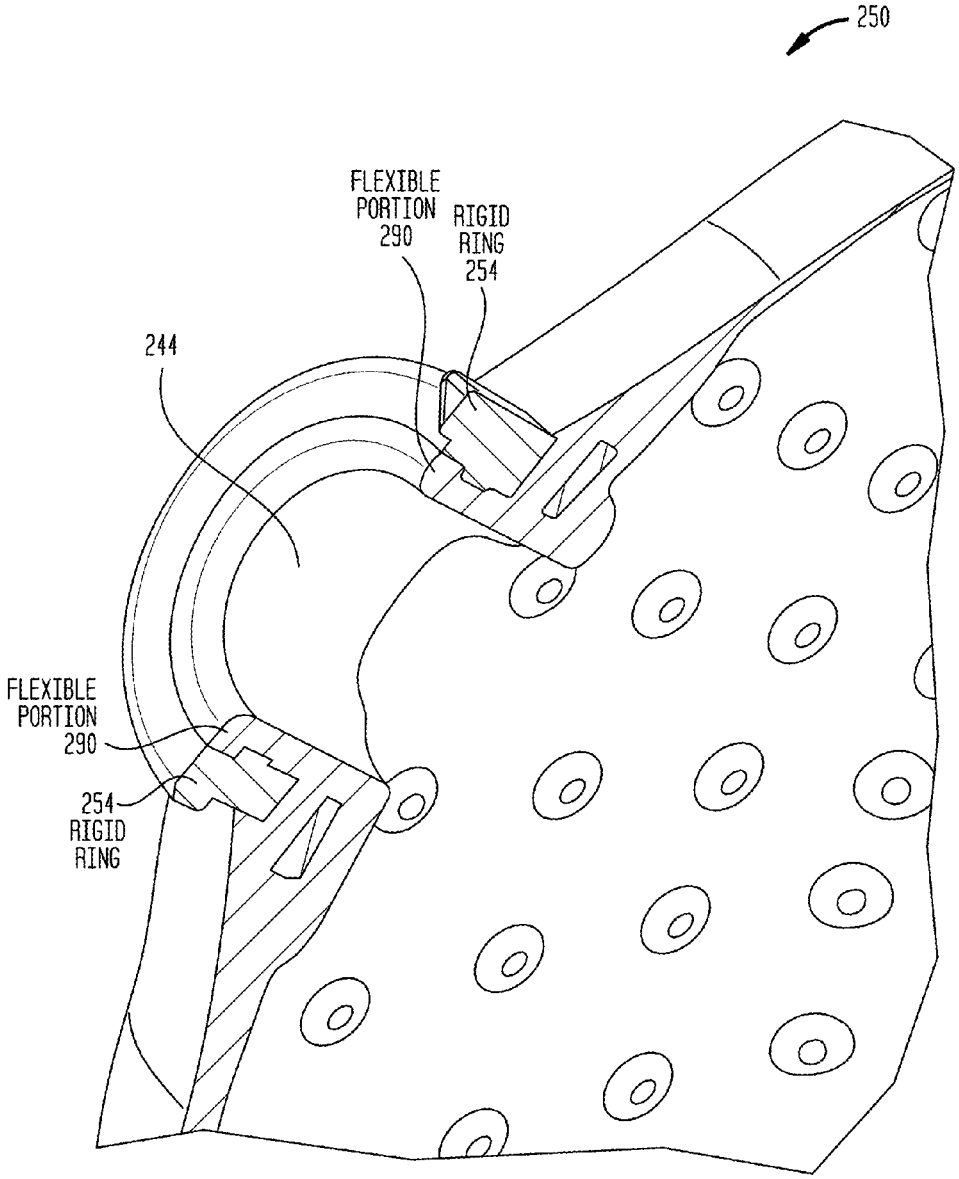
FIG. 6B is a cross-sectional view of the plug port area of FIG. 6A.

FIG. 6A is a perspective of the plug port area 250 that is configured to receive a plug that connects an external device to the sound processor 134 in the protective sleeve 240. FIG. 6B is cross-sectional view of the plug port area 250. In the specific embodiments of FIGS. 6A and 6B, the plug port 244 is configured to receive a cable plug (not shown in FIGS. 6A and 6B) that enables electrical connection of the behind-the-ear sound processor 134 with the external coil 130 (FIG. 1) while the behind-the-ear sound processor 134 is positioned in the protective sleeve 240.

The plug port 244 is an aperture that is surrounded by a portion 290 of the flexible material forming main body 242. The flexible material surrounding plug port 244 is referred to herein as flexible portion 290. Disposed around the flexible portion 290 is the substantially rigid member 254. The substantially rigid member 254 is a rigid port ring that provides structural support for the plug port 244 and, as described further below, allows sealing to occur when a coil cable plug is inserted into the plug port 244.

Figure 6C:
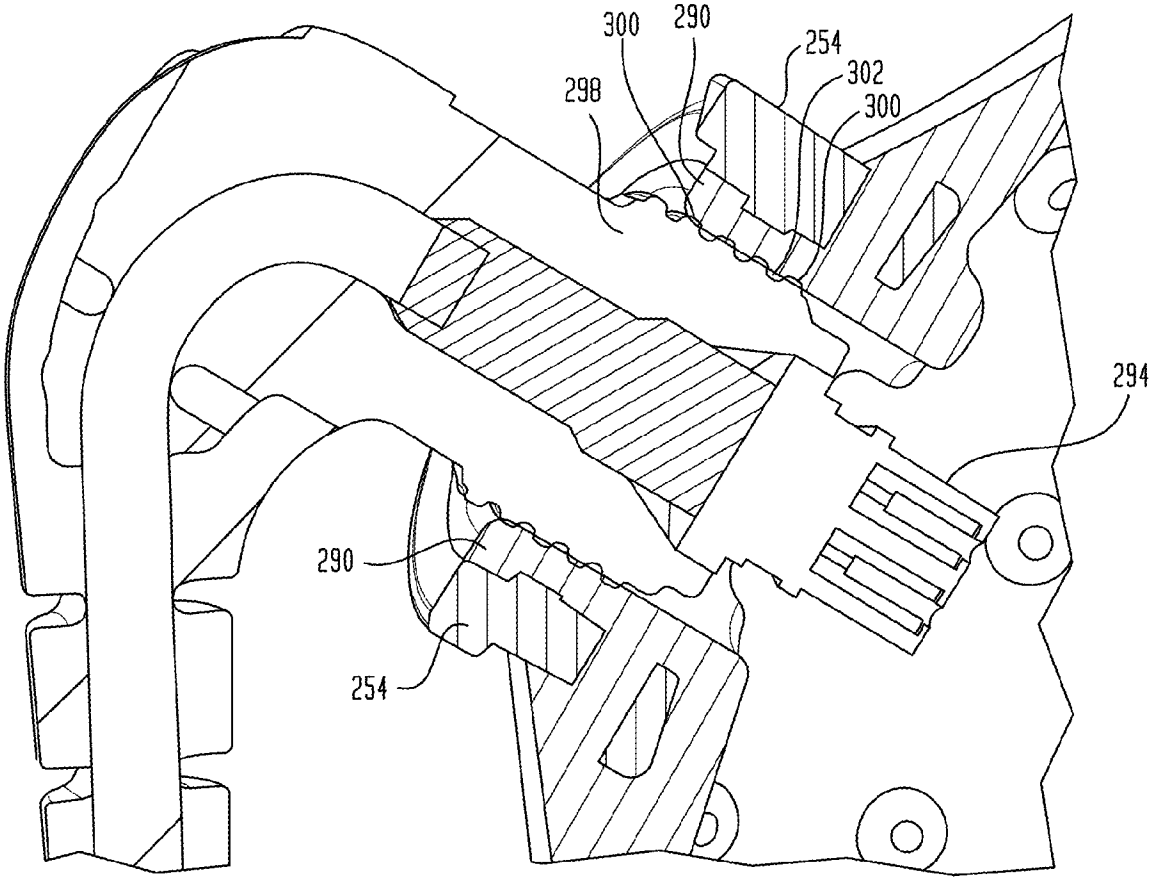
FIG. 6C is a cross-sectional view of a plug disposed into the plug port area of FIG. 6A.

FIG. 6C is a cross-sectional view of the plug port area 250 when a cable plug 292 connected to an external coil is inserted into the plug port 244. As shown, the cable plug 292 includes an electrical connector 294 that electrically connects to an electrical connector of the behind-the-ear sound processor 134. In one embodiment, the cable plug 292 is a male connector that mates with a female receptacle of the behind-the-ear sound processor 134.

The electrical connector 294 is surrounded by a rigid member 298. The outer surface of the rigid member 298 is corrugated so as to include a plurality of ridges/ribs 300 that define a plurality of grooves/troughs 302 extending around the circumference of the rigid member. The rigid member 298 is sized such that when inserted into the plug port 244, the corrugated surface causes deformation of the flexible portion 290 that creates a contaminant-proof seal around the plug port 244. More specifically, the ridges 300 compress the softer flexible portion 290 against the rigid port ring 254 such that sections of the flexible portion will deform into grooves 302. As such, rather than having discrete compressible components such as O-rings or soft flanges on a substantially hard body as in conventional arrangements, the protective sleeve 240 uses compressible material that is integrated with (i.e., forming part of) the main body 242 to seal the plug port 244. In other words, the flexible material forming body 242 provides the dual function of enclosing the behind-the-ear sound processor 134 and operating as a compressible contaminant-proof seal.

As noted above, FIGS. 6A and 6B illustrate an embodiment in which the plug port 244 is configured to receive a cable plug. It is to be appreciated that the plug port 244 may have different sizes/shapes, or be disposed at different locations, for receiving different plugs for connection to different devices or for different purposes. The plug port 244 may be configured to, for example, receive (and seal to) other plugs with integral electrical connectors that electrically connect to different devices, an acoustic tube plug, etc.

Figure 7A:
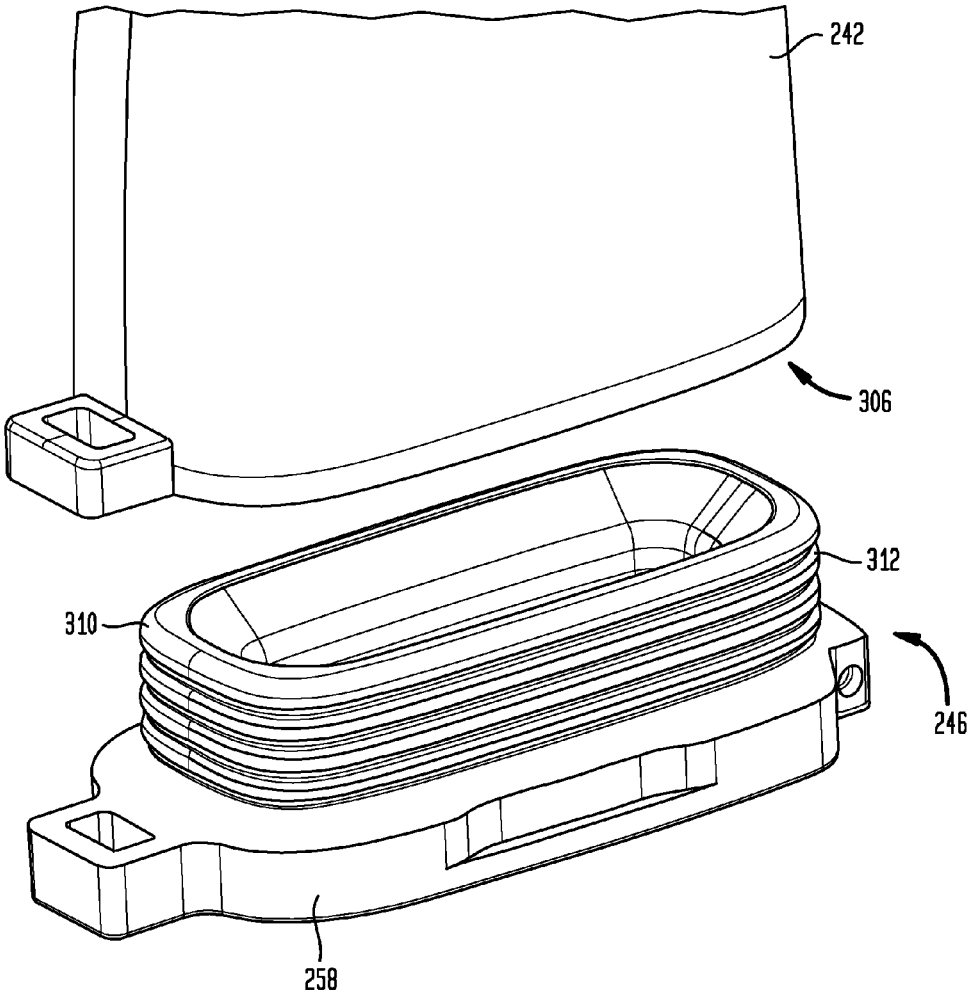
FIG. 7A is a perspective view of a base plug separated from a main body of a protective sleeve in accordance with embodiments presented herein.
Figure 7B:
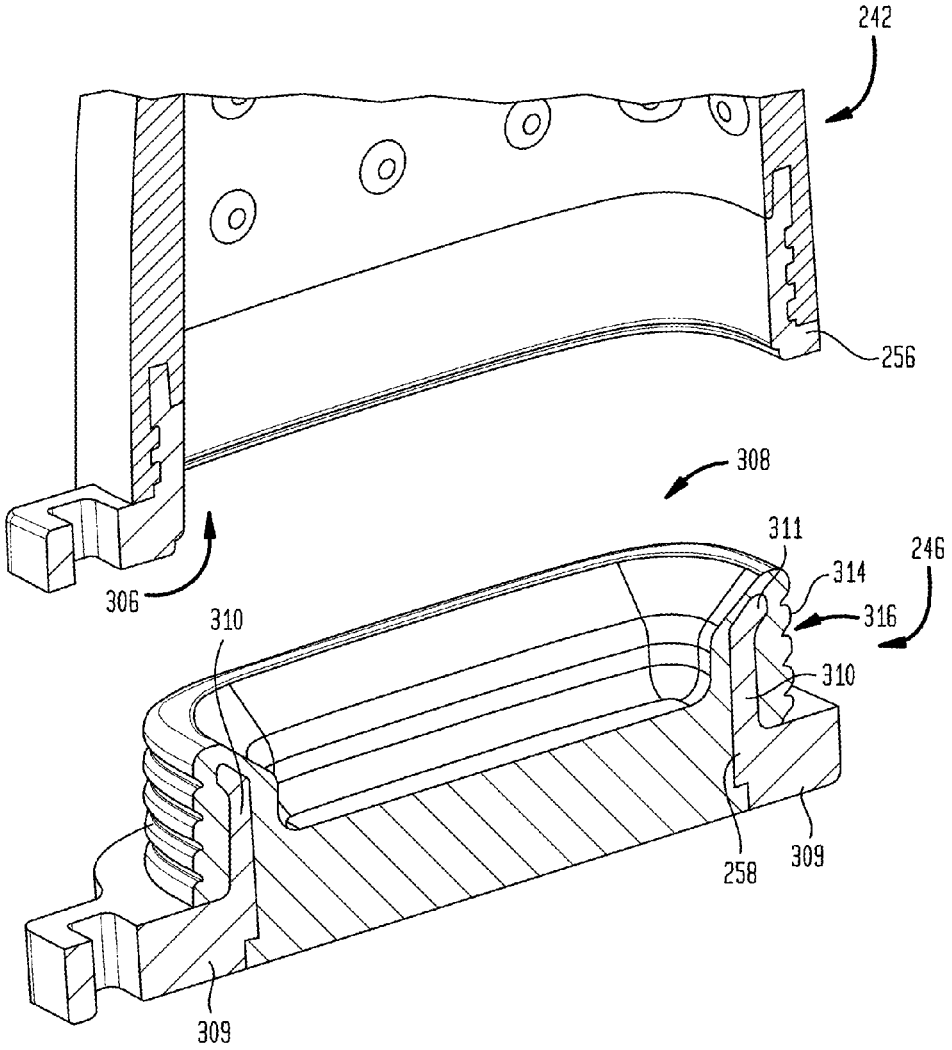
FIG. 7B is a cross-sectional view of the base plug and main body of FIG. 7A.

As noted above, the main body 242 includes a base opening that is closed/sealed by a base plug 246. FIGS. 7A and 7B are perspective and cross-sectional views, respectively, of the base plug 246 shown separate from the main body 242. That is, the base plug 246 is shown removed from base opening 306.

The base opening 306 is surrounded by the rigid member 256. As shown, the rigid member 256 is a rigid base ring extending around the outer edge of the base opening. The main body 242 is molded around the rigid base ring 256.

The base plug 246 comprises a top opening 308 that is surrounded by the rigid member 258. The rigid member 258 comprises a lower ring platform 309 integrated with a rigid plug ring 310. The plug ring 310 extends from the lower platform 309 around the top opening 308. The plug ring 310 terminates in a rigid protrusion 311. The substantially flexible material (e.g., LSR) surrounds the plug ring 310. The portion of the flexible material surrounding the plug ring 310 is referred to herein as flexible member 312. Flexible member 312 is corrugated so as to include a plurality of ridges/ribs 314 that define a plurality of troughs/grooves 316 that are adjacent to the outer surface of plug ring 310.

In certain embodiments, the flexible member 312 may substantially fill the area inside the lower ring platform 309 and the plug ring 310 to form a bottom seal for the protective sleeve 240. In other words, flexible member 312 fills the opening 308. In other embodiments, the lower ring platform 309 is configured as a planar element that forms the bottom seal (i.e., instead of a ring, the bottom of the rigid member 258 is a planar surface).

Figure 7C:
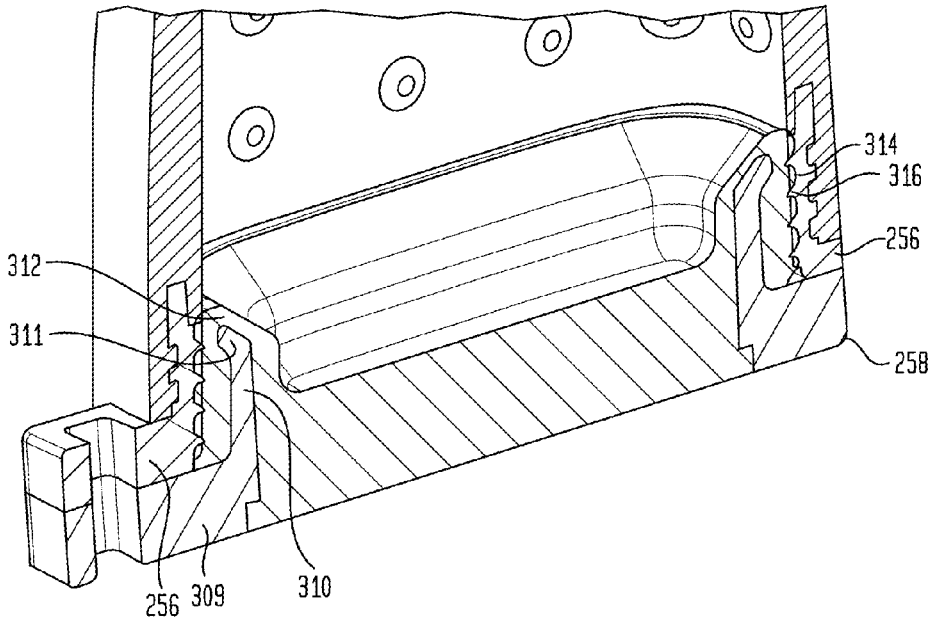
FIG. 7C is a cross-sectional view of the base plug and main body of FIG. 7A where the base plug is shown inserted into the main body.

FIG. 7C is cross-sectional view illustrating the base plug 246 inserted into the base opening 306. When the base plug 246 is inserted into the base opening 306, the flexible member 312 will be compressed by the rigid ring 256 and the rigid member 258. The compression of the soft corrugations (i.e., ridges 314 and troughs 316) of the base plug 246 against the smooth hard part 256 creates a contaminant-proof (e.g., waterproof, dustproof, etc.) seal. That is, the low profile flexible member 312 is compressed/deformed (not deflected) when pushed into the main body 242, thereby creating the lower seal of the protective sleeve 240.

Figure 8:
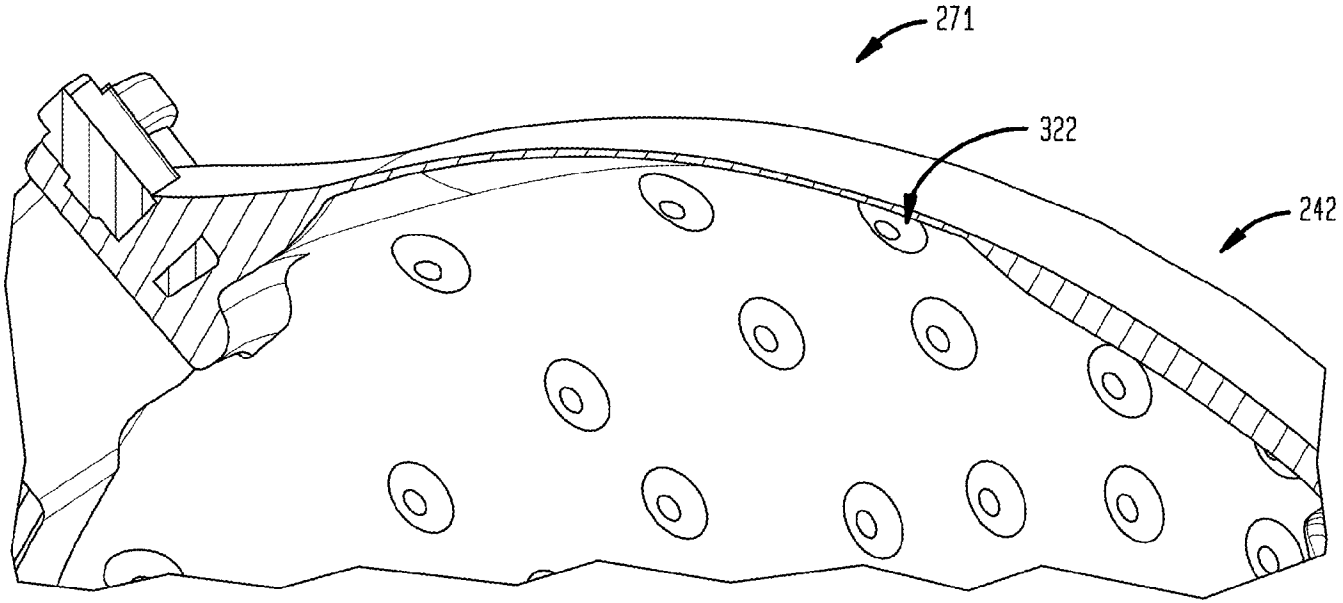
FIG. 8 is a cross-sectional view of an upper edge of a protective sleeve in accordance with embodiments presented herein.

FIG. 8 is cross-sectional view of the upper portion 271 of the main body 242 located between the plug port area 250 and the second section 262 (not shown in FIG. 8). When the behind-the-ear sound processor 134 is inserted into the protective sleeve 240, the microphones of the behind-the-ear sound processor 134 are located adjacent to the upper portion 271 of the main body 242. Therefore, as shown in FIG. 8, the main body 242 has a cross-section 322 that is thinner that the cross-section of the rest of the main body 242. That is, the upper portion 271 of the main body 242 is locally thinned to create a relatively thin membrane that allows uninterrupted sound transmission from outside the protective sleeve 240 to the microphones. In certain embodiments, the upper portion 271 may have a thinned cross-section 322 in the range of, for example, approximately 0.1 mm to approximately 0.5 mm. In certain embodiments, the remainder of main body 242 outside of the upper portion 271 may have a cross-section of approximately 1 mm.

Figure 9:
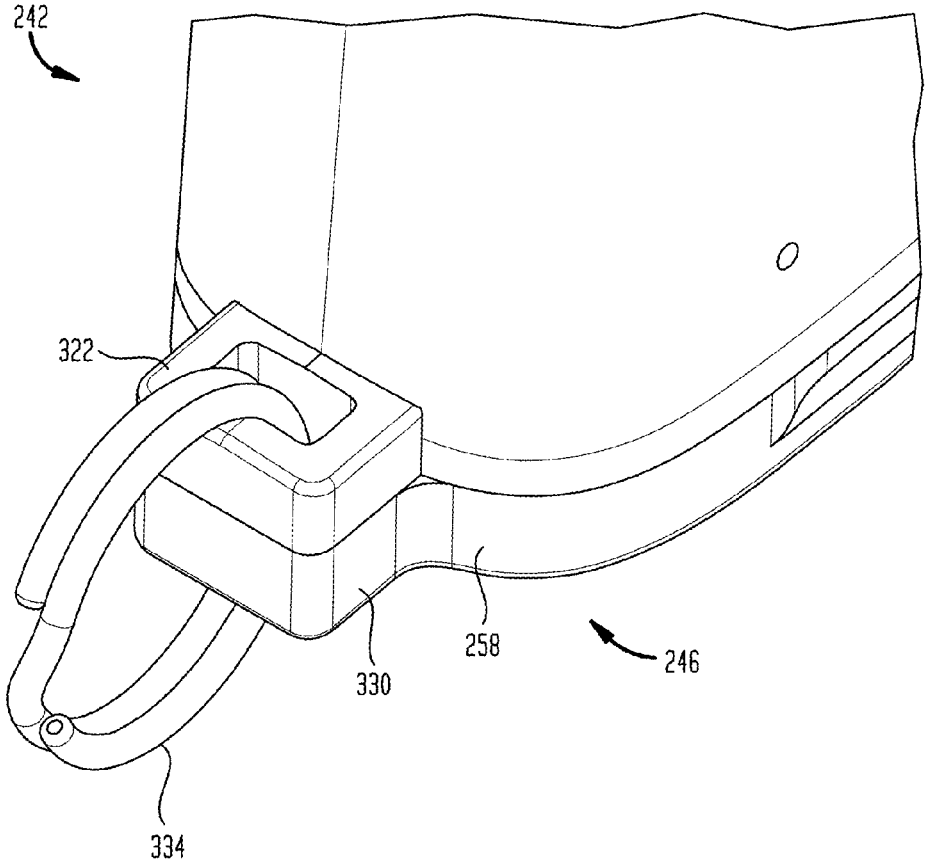
FIG. 9 is a perspective view illustrating a connecting ring in accordance with embodiments presented herein.

FIG. 9 is perspective view of the base plug 246 inserted into the main body 242. As shown, the rigid member 256 molded into the main body 242 includes a rigid loop 332 extending outside of the main body 242. Similarly, the rigid member 258 molded into the base plug 246 comprises a corresponding rigid loop 330 that, when the base plug 246 is inserted into the main body 242, is positioned abutting the rigid loop 332. A connecting ring 334 may extend through both rigid loops 330 and 332. The connecting ring 334 operates as a connector between the main body 242 and the base plug 246.

Figure 10:
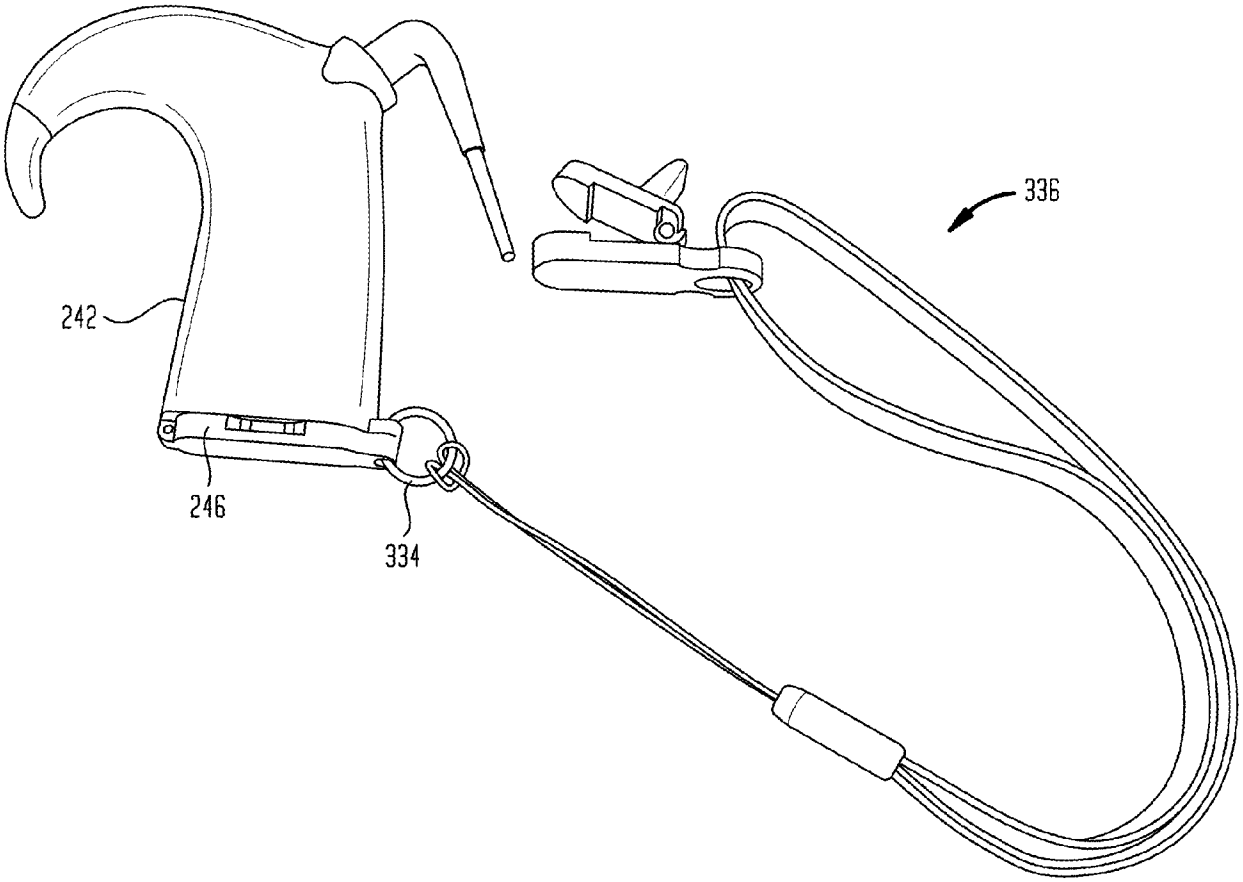
FIG. 10 is a perspective view illustrating a loss prevention mechanism in accordance with embodiments presented herein.

Additionally, as shown in FIG. 10, the connecting ring 334 may be used as an attachment point for a loss prevention mechanism 336. In the embodiment of FIG. 10, the loss prevention mechanism 336 comprises a lanyard 338 that has a first end looped around the connecting ring 334 and a second end coupled to a clip 340 that may be attached to the recipient's clothing. In certain embodiments, the connecting ring 334 is made from stainless steel (e.g., 316 stainless steel). Stainless steel 316 may be advantageous as it is corrosion resistant when exposed to salt water, it will remain aesthetically shiny, and it is strong enough to perform the task of loss prevention.

The above embodiments have been primarily described with reference to a protective sleeve for a behind-the-ear sound processor. As noted elsewhere herein, protective sleeves in accordance with embodiments of the present invention may be configured for use with other external elements of a hearing prosthesis. For example, a protective sleeve in accordance with other embodiments may be used with a button processor of a cochlear implant.

Traditionally, sound input elements, sound processing elements, and the power source of a cochlear implant are housed in a behind-the-ear component. The behind-the-ear component is connected to an external coil via a cable. A button processor is a single unit that includes the sound input elements, sound processing elements, power source, and external coil. That is, in a button processor all of the external components of a cochlear implant are integrated into a single housing. Button processors also include a magnet and are worn at a location where this magnet can be magnetically coupled to an implantable magnet.

Figure 11A:
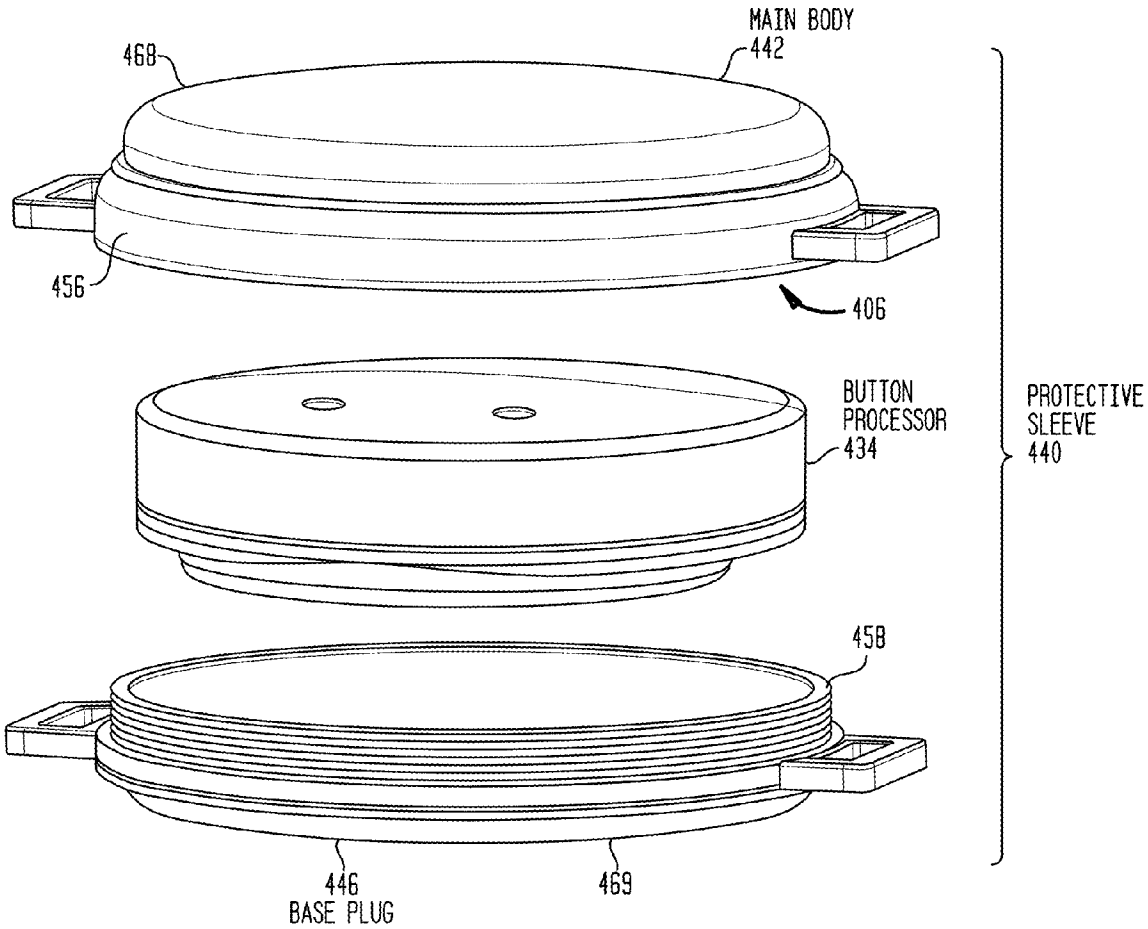
FIG. 11A is a perspective, exploded view of a protective sleeve in accordance with embodiments presented herein for use with a button processor.
Figure 11B:
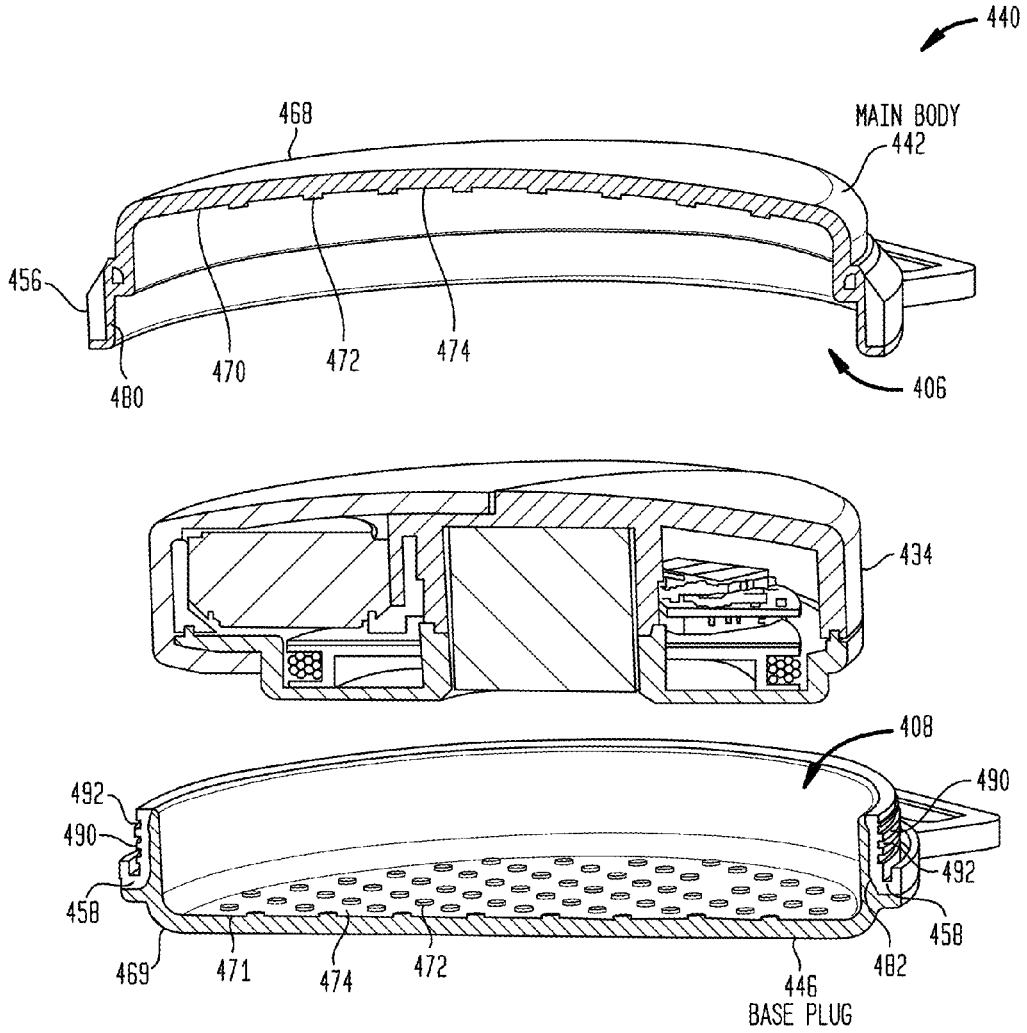
FIG. 11B is a cross-sectional view of the protective sleeve of FIG. 11A shown in an open configuration.
Figure 11C:
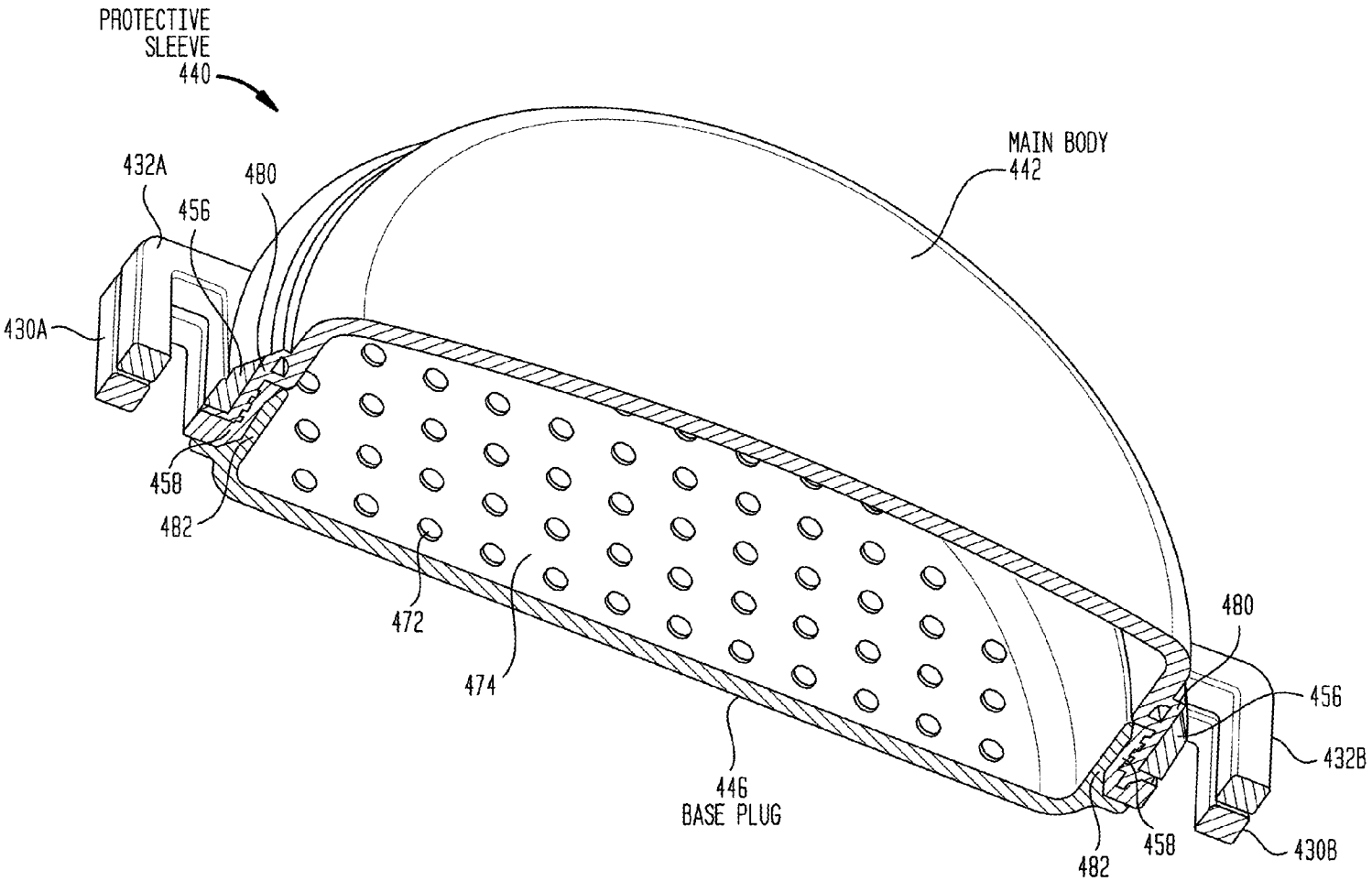
FIG. 11C is a cross-sectional view of the protective sleeve of FIG. 11A shown in the closed configuration.
Figure 11D:
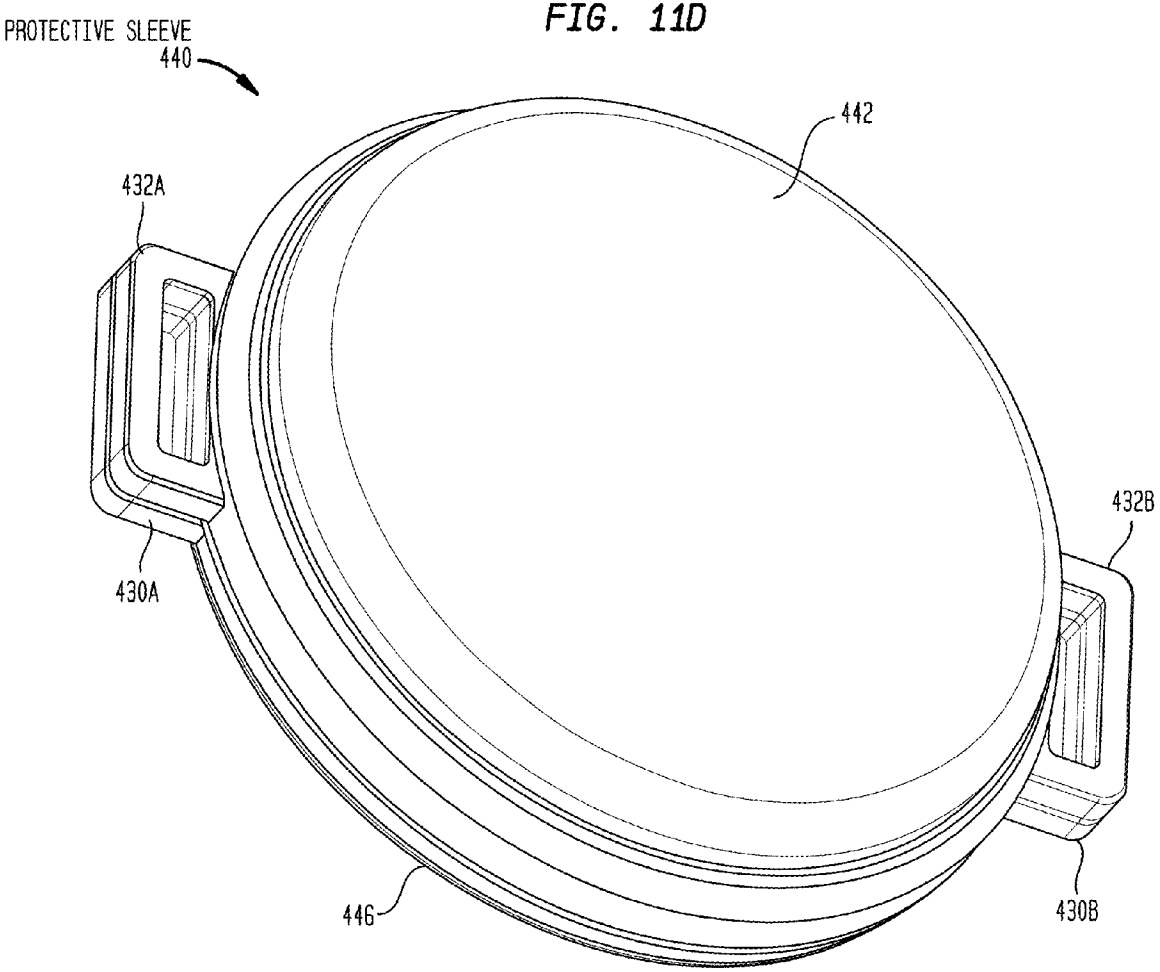
FIG. 11D is a perspective view of the protective sleeve of FIG. 11A shown in a closed configuration.

FIGS. 11A-11D illustrate a protective sleeve 440 in accordance with embodiments presented herein for use with a button processor. More specifically, FIG. 11A is perspective, exploded view of the protective sleeve 440 and a button processor 434, while FIG. 11B is a cross-sectional view of the protective sleeve 440 shown in an open configuration. FIGS. 11C and 11D are cross-sectional and perspective views, respectively, of the protective sleeve 440 in a closed configuration.

In general, the protective sleeve 440 is configured to substantially prevent the ingress of water, dust, and other contaminants that could potentially damage the electrical elements of the button processor 434. However, protective sleeve 440 is also configured to enable the button processor 434 to continue operation while the button processor is positioned in the protective sleeve.

The protective sleeve 440 comprises two mating halves that are secured together in a manner that seals the button processor 434 within the protective sleeve. The first mating half of the protective sleeve 440 is referred to herein as a main body 442. Main body 442 includes a base opening 406. The second mating half of the protective sleeve 440 is referred to herein as a base plug 446. The base plug 446 includes a top opening 408. In a closed configuration, the base plug 446 is configured to mate with the main body 442 to enclose the button processor 434. The main body 442 and base plug 446 collectively form a flexible shell.

The main body 442 and base plug 446 are primarily formed from a substantially flexible and contaminant-proof material. In certain embodiments, the main body 442 is a soft silicone material such as LSR. As noted above, LSR provides a soft, stretchy and flexible outer shell that can withstand significant abuse.

The material used to form the flexible portions of main body 442 and base plug 446 may have a Shore A hardness of approximately 40 (40 Shore A). It is appreciated that other similar materials and hardness (e.g., in the range between approximately Shore 20A and 60A) may be used in alternative embodiments.

The main body 442 is integrated with (i.e., molded over and/or around) a substantially rigid member 456. Similarly, the base plug 446 is integrated with a substantially rigid member 458. As described further below, the substantially rigid members 456 and 458 interact with the main body 442 and/or other substantially flexible portions of the protective sleeve 440 to seal the button processor 434 in the sleeve in a manner that prevents the ingress of water, dust, and other contaminants that could potentially damage the electrical elements of the button processor 434.

The material forming the rigid members 456 and 458 is substantially harder than the material forming the main body 442 and base plug 446. For example, in certain embodiments the rigid members 456 and 458 have a Shore D hardness of 80. It is appreciated that other similar materials and hardness (e.g., in the range between Rockwell R 50 and Rockwell R 120.) may be used in alternative embodiments.

The main body 442 and base plug 446 may be formed from a clear (transparent) material, while the rigid members 456 and 458 may be formed from opaque materials. It is to be appreciated that other combinations are also possible.

The main body 442 and base plug 446 are configured to be substantially form (close) fitting to the button processor 434. Such close fitting may be considered aesthetically pleasing since it adds minimal bulk to the button processor 434. Furthermore, since the protective sleeve 440 it is as streamlined as possible, there is minimal surface area for contaminants to strike while in use while, for example, swimming. This minimal surface area improves retention during such activities.

In certain embodiments, the exterior/outer surface 468 of the main body 442 and/or the exterior surface 469 of base plug 446 are designed to have a polished finish. The polished finished improves the clarity and transparency of the protective sleeve 440 so that a recipient or other user can see through to the inside of the protective sleeve 440. Additionally, a high polish finish on the flexible material results in an exterior surface that, relative to an unpolished surface, is easier for a recipient or other user to grip. An exterior surface that is easy to grip makes it easier for the recipient to handle the protective sleeve 440 during installation and removal of the button processor 434, as well as during general use. In further embodiments, a polished finish on the outer surfaces 468 and/or 469 may result in a product that has increased friction with the recipient's skin, hair, etc., thereby creating a "sticking" effect that results in improved retention of the protective sleeve 440 and the button sound processor 434 when worn by a recipient.

As noted, FIG. 11B is a cross-sectional view of the protective sleeve 440. FIG. 11B illustrates that the inner surfaces 470 and 471 of the main body 442 and the base plug 446, respectively, include a plurality of protruding dimples 472. The areas 474 of the inner surfaces 470 and 471 between the dimples 472 may also be textured/roughened. For example, the areas 474 may be textured to a specific EDM finish. In one specific example, the areas 474 have an EDM finish of VDI CH 36. In operation, the textured surface areas 474 and the dimples 472 make it easier to install and remove the button processor 434. Without these features, the button processor 434 could be difficult to install and remove, due to the form fitting design and the inherent stickiness of the flexible material forming main body 442 and base plug 446. The dimples 472 may also provide an aesthetic benefit, giving the appearance of water droplets when viewed from the outside of the protective sleeve 440.

The base opening 406 is surrounded by a portion 480 of the main body 442. This portion 480 is further surrounded by rigid member 456. That is, as shown, the rigid member 456 is a rigid base ring extending around the outer edge of the base opening 406 adjacent to flexible portion 480.

The top opening 408 is surrounded by a portion 482 of the base plug 446. This portion 482 is further surrounded by rigid member 458. That is, as shown, the rigid member 458 is a rigid plug ring extending around the outer edge of the top opening 408 adjacent to flexible portion 482.

The outer surface of the rigid member 458 is corrugated so as to include a plurality of ridges/ribs 490 that define a plurality of grooves/troughs 492 extending around the circumference of the rigid member. The rigid member 458 is also configured to be inserted into the base opening 406. As shown in FIG. 11C, when the rigid member 458 is inserted into the base opening 406, the rigid member 458 causes deformation of the flexible portion 480 that creates a contaminant-proof seal around the base opening 406. More specifically, the ridges 490 compress the softer flexible portion 490 such that sections of the flexible portion will deform into the grooves 492. As such, rather than having discrete compressible components such as O-rings or soft flanges on a substantially hard body as in conventional arrangements, the protective sleeve 440 uses compressible material that is integrated with (i.e., forming part of) the main body 442 to seal the mating halves 442 and 446 to one another. In other words, the flexible material forming body 442 provides the dual function of enclosing the button processor 434 and operating as a compressible seal.

FIG. 11D is perspective view of the protective sleeve 440 in a closed configuration where the base plug 446 is mated with (i.e., inserted into) the main body 442. As shown, the rigid member 456 molded into the main body 442 includes first and second rigid loops 432A and 432B extending outside of the main body 442. Similarly, the rigid member 458 in base plug 446 comprises corresponding rigid loops 430A and 430B that, when the base plug 446 is inserted into the main body 442, are positioned abutting the rigid loops 432A and 432B, respectively. A connecting ring (not shown in FIG. 11D) or a headband (also not shown in FIG. 11D) may be attached to one or both of the abutting rigid loops 430A/432A and/or 430B/432B. The headband may be used to secure the protective sleeve 440 and button processor to the recipient's head. The connecting ring could be used as an attachment point for a loss prevention mechanism as described above.

Figure 11E:
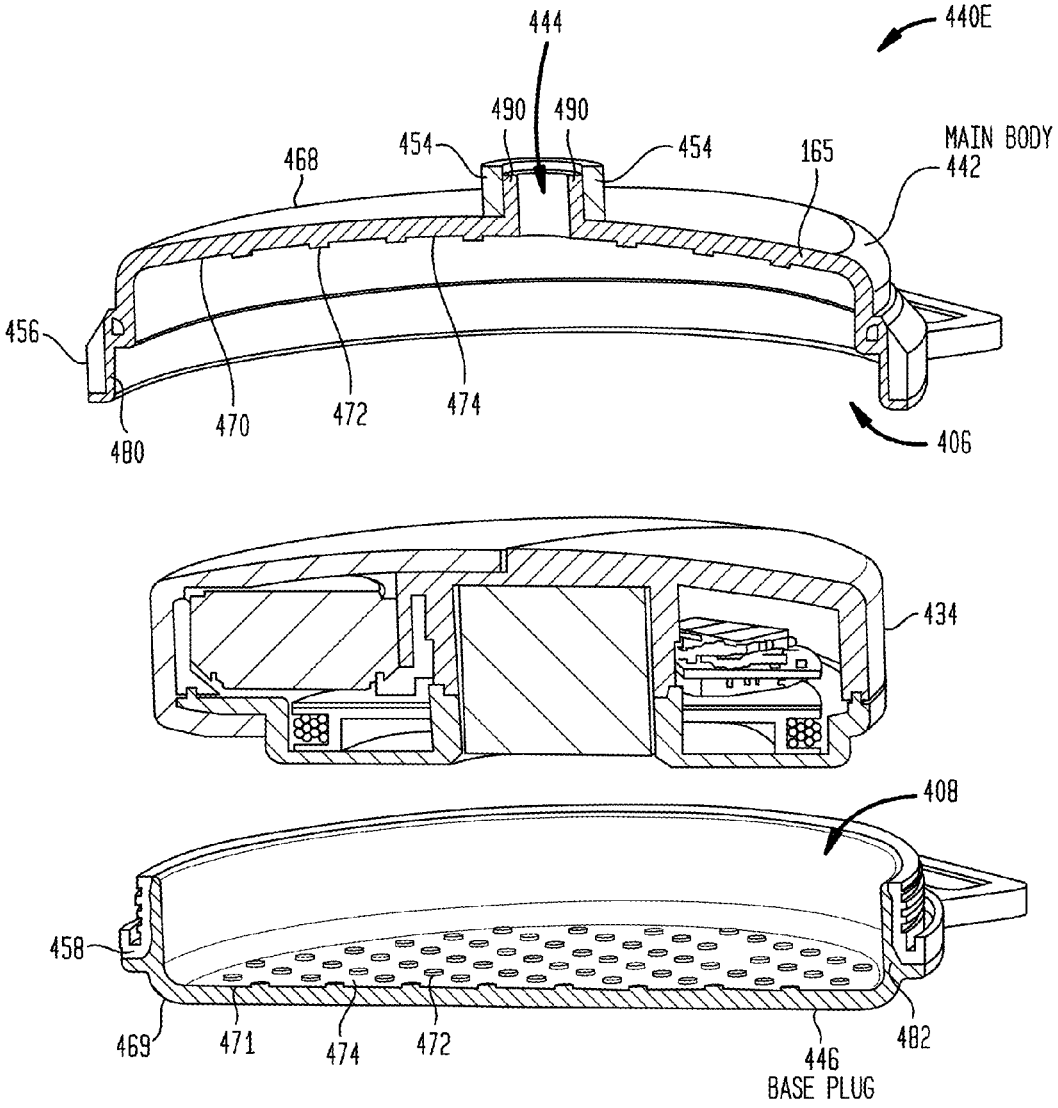
FIG. 11E is a cross-sectional view of a protective sleeve for a button processor that includes a plug port.

FIG. 11E illustrates another protective sleeve 440E in accordance with embodiments presented herein for use with a button processor (not shown). The protective sleeve 440E is substantially similar to the protective sleeve 440 shown in FIGS. 11A-11D. However, the protective sleeve 440E further comprises a plug port 444 configured to receive (and seal to) a plug. The plug port 444 may be configured to, for example, receive (and seal to) plugs with integral electrical connectors that electrically connect to various devices, an acoustic tube plug, etc.

The plug port 444 is an aperture that is surrounded by a portion 490 of the flexible material forming main body 442. The flexible material surrounding plug port 444 is referred to herein as flexible portion 490. Disposed around the flexible portion 490 is a substantially rigid member 454. The substantially rigid member 454 is a rigid port ring that provides structural support for the plug port 444 and, as described further below, allows sealing to occur when a plug is inserted into the plug port 444.

More specifically, when a rigid plug (not shown) is inserted into the plug port 444, the rigid plug and rigid port ring 454 cause deformation of the flexible portion 490 that creates a contaminant-proof seal around the plug port 444. In certain embodiments, the rigid plug includes a corrugated outer surface with ridges that compress the softer flexible portion 490 against the rigid port ring 454 such that sections of the flexible portion will deform into grooves defined by the ridges of the plug. As such, rather than having discrete compressible components such as O-rings or soft flanges on a substantially hard body as in conventional arrangements, the protective sleeve 440E uses compressible material that is integrated with (i.e., forming part of) the main body 442 to seal the plug port 444. In other words, the flexible material forming body 442 provides the dual function of enclosing the button processor and operating as a compressible contaminant-proof seal.

Figure 12A:
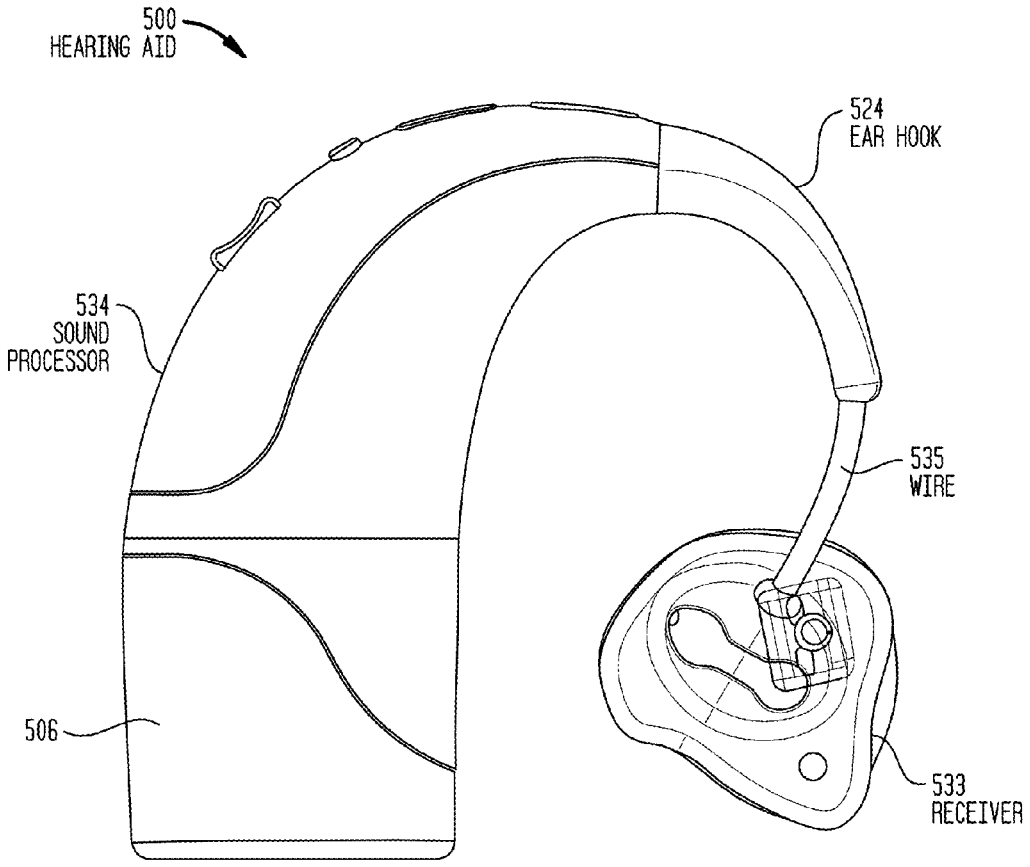
FIG. 12A is a side view of an acoustic hearing aid for use with a protective sleeve in accordance with embodiments presented herein.

FIG. 12A illustrates another hearing prosthesis, namely an acoustic hearing aid 500, with which a protective sleeve in accordance with embodiments presented herein may be used. As shown in FIG. 12A, the acoustic hearing aid 500 is a receiver-in-the-ear (RITE) hearing aid that comprises a behind-the-ear sound processor 534 and a receiver 533.

The behind-the-ear sound processor 634 includes a substantially hard housing 506. One or more sound input elements, such as microphones, telecoils, etc. for detecting sound are disposed in (or on) the housing 506. A power source (not shown) and sound processing elements (also not shown) are also disposed in the housing 506.

The receiver 533 is, in essence, equivalent to a small speaker and is configured to be placed in the ear of the user. However, the electronics (i.e., sound input elements, sound processing elements, power source, etc.) are hidden behind the ear in the sound processor 534. As shown in FIG. 12A, the receiver 533 is physically and electrically connected to the sound processor 534 via a wire/tube 535 and an ear hook 524. In certain embodiments, the wire 535 is a thin and clear wire that is substantially invisible.

The ear hook 524 is a rigid member that is configured to attach the behind-the-ear sound processor 534 to the recipient's ear. That is, while in use, the ear hook 524 hangs on the top of the recipient's outer ear such that the sound processor 534 lies substantially behind the recipient's outer ear.

Figure 12B:
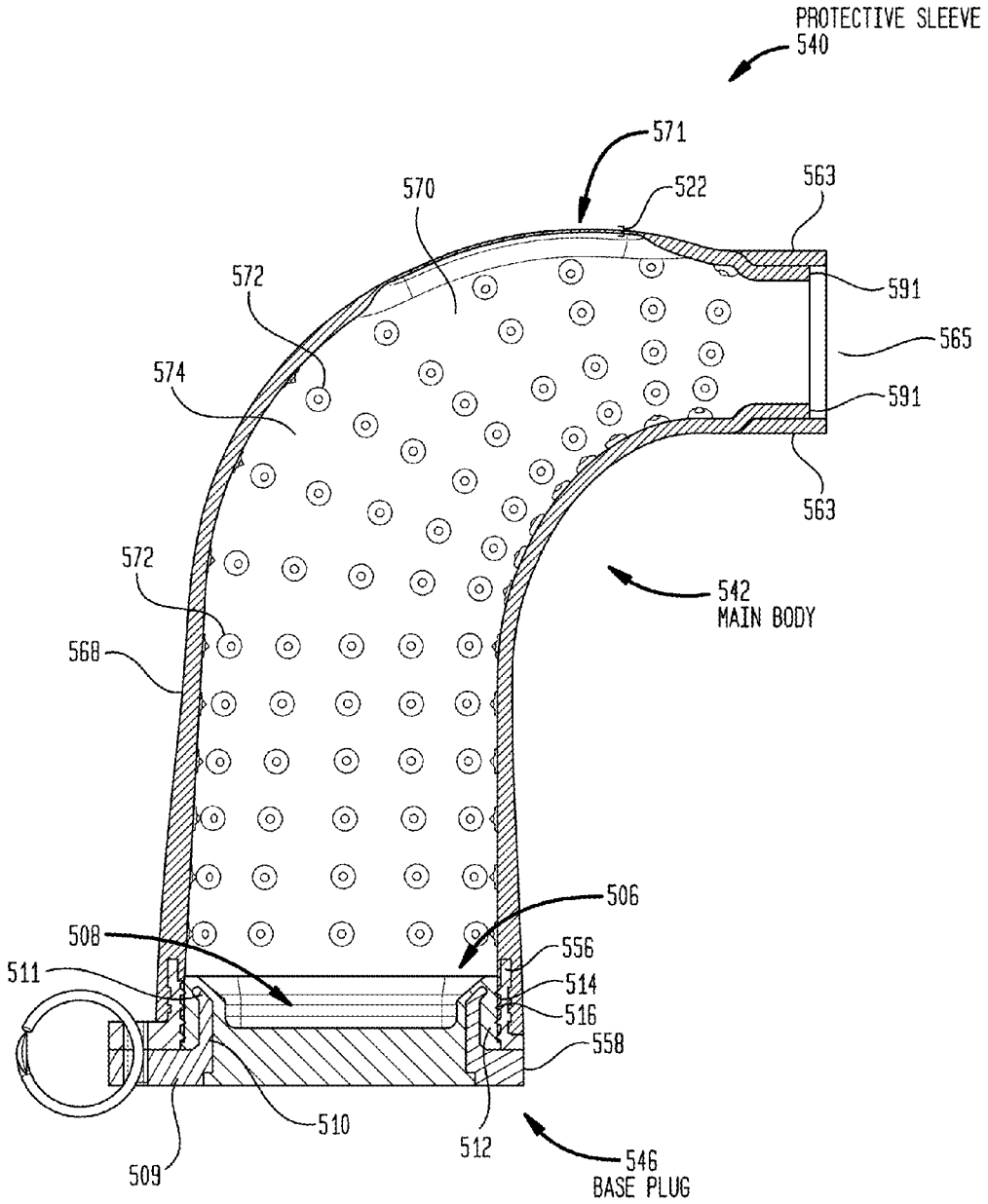
FIG. 12B is a cross-sectional view of a protective sleeve in accordance with embodiments present herein for use with the acoustic hearing aid of FIG. 12A.
Figure 12C:
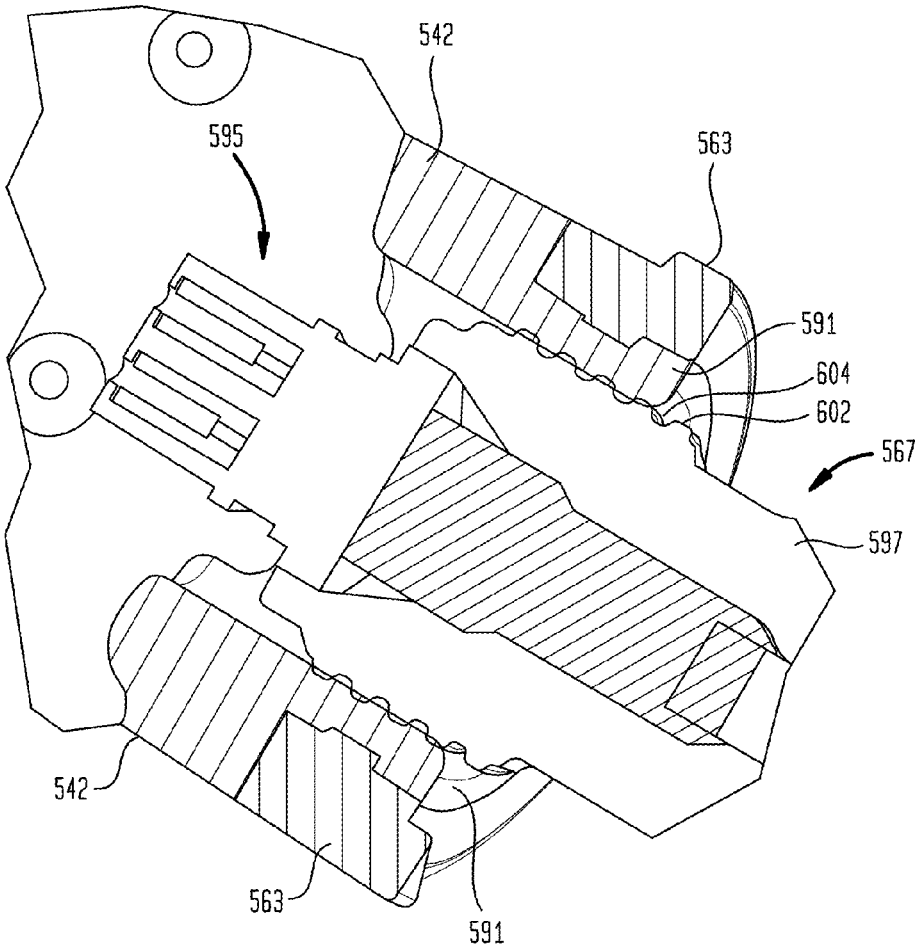
FIG. 12C is a cross-sectional view of an ear hook plug disposed into the ear hook port of FIG. 12B.

FIG. 12B is a cross-sectional view of a protective sleeve 540 in accordance with embodiments present in which the behind-the-ear sound processor 534 of the acoustic hearing aid 500 may be positioned. FIG. 12C is cross-sectional view of a portion of the protective sleeve that enable connection of the sound processor 534 to the ear hook 524 while the sound processor is positioned in the protective sleeve 540. For ease of illustration, the sound processor 534 is omitted from FIG. 12B.

In general, the protective sleeve 540 is primarily formed from a substantially flexible material that is form fitting to the behind-the-ear sound processor 534. The substantially flexible material is integrated with discrete rigid members. The rigid members interact with one another and the flexible material to substantially prevent the ingress of water, dust, and other contaminants that could potentially damage the electrical elements of the sound processor 534. Protective sleeve 540 is also configured to enable the sound processor 534 to continue operation while the sound processor is positioned in the protective sleeve.

As shown in FIG. 12B, the protective sleeve 540 comprises a main body 542 that includes a base opening 506 and an ear hook port 565. The base opening 506 is configured to be substantially closed by a base plug 546. That is, the protective sleeve 540 comprises a base plug 546 that is configured to mate with the main body 542 to seal the base opening 506. The main body 542 and base plug 546 collectively form a flexible shell.

The main body 542 and base plug 546 are primarily formed from a substantially flexible and contaminant-proof (e.g., waterproof, dust proof, etc.) material. In certain embodiments, the substantially flexible material is LSR. As described further below, the substantially flexible material comprises the overall shell for the protective sleeve 540, but also operates as the sealing elements. In other words, the contaminant proof seals of the protective sleeve 540 are formed by the flexible material reinforced with rigid (e.g., hard plastic) members.

The flexible material used to form main body 542 and base plug 546 may have a Shore A hardness of approximately 40 (40 Shore A). It is appreciated that other similar materials and hardness (e.g., in the range between Shore 20A and 60A) may be used in alternative embodiments.

The main body 542 is integrated with (e.g., molded over and/or around) substantially rigid members 556 and 563. Similarly, the base plug 546 is integrated with a substantially rigid member 558. As described further below, the substantially rigid members 556, 563, and 558 interact with the flexible material of the main body 542 and/or base plug 546 to seal the behind-the-ear sound processor 534 in the sleeve in a manner that prevents the ingress of water, dust, and other contaminants that could potentially damage the electrical elements of the behind-the-ear sound processor 534.

The material forming the rigid members 556, 558, and 563 is substantially harder than the flexible material forming the main body 542 and base plug 546. For example, in certain embodiments the rigid members 556, 558, and 563 have a Shore D hardness of 80. It is appreciated that other similar materials and hardness (e.g., in the range between Rockwell R 50 and Rockwell R 120) may be used in alternative embodiments.

In certain embodiments, the main body 542, base plug 546, rigid member 556, and rigid member 563 may be formed from substantially clear (transparent) materials, while the rigid member 558 is formed from an opaque rigid material. In other embodiments, main body 542 and base plug 546 may be formed from a substantially clear flexible material, while the rigid members 556, 558, and 564 are formed from opaque rigid materials. It is to be appreciated that other combinations of clear, opaque, or other colors are also possible in different embodiments.

The main body 542 is configured to be substantially form (close) fitting to the behind-the-ear sound processor 534. The close fitting between the main body 542 and the behind-the-ear sound processor 534 may be considered aesthetically pleasing since it adds minimal bulk to the behind-the-ear sound processor 534, thereby improving retention and reducing irritation for the receipt, as compared to traditional arrangements. Furthermore, since the protective sleeve 540 is as streamlined as possible, there is minimal surface area for water or other contaminants to strike while, for example, swimming. This minimal surface area improves retention during such activities.

In certain embodiments, the exterior/outer surface 568 of the main body 542 is designed to have a polished finish. The polished finished improves the clarity and transparency of the flexible material so that a recipient or other user can see through to the inside of the protective sleeve 540. Additionally, a high polish finish results in an exterior surface 568 that, relative to an unpolished surface, is relatively easier for a recipient or other user to grip. An exterior surface 568 that is easy to grip makes it easier for the recipient to handle the protective sleeve 540 during installation and removal of the behind-the-ear sound processor 534, as well as during general use. In further embodiments, a polished finish on the outer surface 568 may result in a product that has increased friction with the recipient's skin, thereby creating a "sticking" effect that results in improved retention of the protective sleeve 540 and the behind-the-ear sound processor 134 when worn by a recipient.

Also as shown in FIG. 12B, the inner surface 570 of the main body 542 has a plurality of protruding dimples 572 and areas 574 between the dimples. The dimples 572 and/or the areas 574 are textured/roughened surfaces. For example, the dimples 572 and areas 574 may be textured to a specific EDM finish. In one specific example, the dimples 572 and areas 574 have an EDM finish of VDI CH 36. In operation, the textured surface areas 574 and the dimples 572 make it easier to install and remove the behind-the-ear sound processor 534. Without these features, the behind-the-ear sound processor 534 would be very difficult to install and remove, due to the form fitting shape/design and the inherent "stickiness" of the flexible material forming main body 542. The dimples 572 may also provide an aesthetic benefit, giving the appearance of water droplets when viewed from the outside of the protective sleeve 540.

As noted above, the hearing aid 500 is configured to continue operation while positioned in the protective sleeve 540. The hearing aid 500 operates by receiving sound signals at the sound input elements in/on the sound processor 534 that convert the received sound signals into electrical signals. These electrical signals are processed by the sound processing elements in the sound processor 534. The processed electrical signals are provided to the receiver 533 via the ear hook 524 and wire 535. Therefore, to continue operation while in the protective sleeve 540, the sound processor 534 needs to be physically and electrically connected to the ear hook 524. To enable such connection, the protective sleeve 540 includes an ear hook port 565.

The ear hook port 565 is configured to receive an ear hook plug 567 (shown in FIG. 12C). The ear hook plug 567 is an aperture that is surrounded by a portion 591 of the flexible material forming main body 542. The flexible material surrounding ear hook port 565 is referred to herein as flexible portion 591. Disposed around the flexible portion 591 is the substantially rigid member 554. The substantially rigid member 554 is a rigid port ring that provides structural support for the ear hook port 565 and, as described further below, allows sealing to occur when the ear hook plug 567 is inserted into the ear hook port 565.

As shown in FIG. 12C, the ear hook plug 567 includes an electrical connector 595 that electrically connects to an electrical connector of the behind-the-ear sound processor 534. In one embodiment, the electrical connector 595 is a male connector that mates with a female receptacle of the behind-the-ear sound processor 534.

The electrical connector 595 is surrounded by a rigid member 597. The outer surface of the rigid member 597 is corrugated so as to include a plurality of ridges/ribs 602 that define a plurality of grooves/troughs 604 extending around the circumference of the rigid member. The rigid member is sized such that when inserted into the ear hook port 565, the corrugated surface causes deformation of the flexible portion 591 that creates a contaminant-proof seal around ear hook port 565. More specifically, the ridges 602 compress the softer flexible portion 591 against the rigid port ring 563 such that sections of the flexible portion will deform into grooves 604. As such, rather than having discrete compressible components such as O-rings or soft flanges on a substantially hard body as in conventional arrangements, the protective sleeve 540 uses compressible material that is integrated with (i.e., forming part of) the main body 542 to seal the ear hook port 565. In other words, the flexible material forming body 542 provides the dual function of enclosing the behind-the-ear sound processor 534 and operating as a compressible contaminant-proof seal.

As noted above, the main body 542 includes a base opening 506 that is closed/sealed by a base plug 546. The base opening 506 is surrounded by the rigid member 556. As shown, the rigid member 556 is a rigid base ring extending around the outer edge of the base opening. The main body 542 is molded around the rigid base ring 556.

The base plug 546 comprises a top opening 508 that is surrounded by the rigid member 558. The rigid member 558 comprises a lower ring platform 509 integrated with a rigid plug ring 510. The plug ring 510 extends from the lower platform 509 around the top opening 508. The plug ring 510 terminates in a rigid protrusion 511. The substantially flexible material (e.g., LSR) surrounds the plug ring 510. The portion of the flexible material surrounding the plug ring 510 is referred to herein as flexible member 512. Flexible member 512 is corrugated so as to include a plurality of ridges/ribs 514 that define a plurality of troughs/grooves 516 that are adjacent to the outer surface of plug ring 510.

In certain embodiments, the flexible member 512 may substantially fill the area inside the lower ring platform 509 and the plug ring 510 to form a bottom seal for the protective sleeve 540. In other words, flexible member 512 fills the opening 508. In other embodiments, the lower ring platform 509 is configured as a planar element that forms the bottom seal (i.e., instead of a ring, the bottom of the rigid member 558 is a planar surface).

When the base plug 546 is inserted into the base opening 506, the flexible member 512 will be compressed by the rigid ring 556 and the rigid member 558. The compression of the soft corrugations (i.e., ridges 514 and troughs 516) of the base plug 546 against the smooth hard part 556 creates a contaminant-proof (e.g., waterproof, dustproof, etc.) seal. That is, the low profile flexible member 512 is compressed/deformed (not deflected) when pushed into the main body 542, thereby creating the lower seal of the protective sleeve 540.

When the behind-the-ear sound processor 534 is inserted into the protective sleeve 240, the microphones of the behind-the-ear sound processor 534 are located adjacent to an upper portion 571 of the main body 542. Therefore, the main body 542 has a cross-section 522 that is thinner that the cross-section of the rest of the main body 542. That is, the upper portion 571 of the main body 542 is locally thinned to create a relatively thin membrane which allows uninterrupted sound transmission from outside the protective sleeve 540 to the microphones. In certain embodiments, the upper portion 571 may have a thinned cross-section 522 in the range of, for example, approximately 0.1 mm to approximately 0.5 mm. In certain embodiments, the remainder of main body 542 outside of the upper portion 571 may have a cross-section of approximately 1 mm.

Figure 13A:
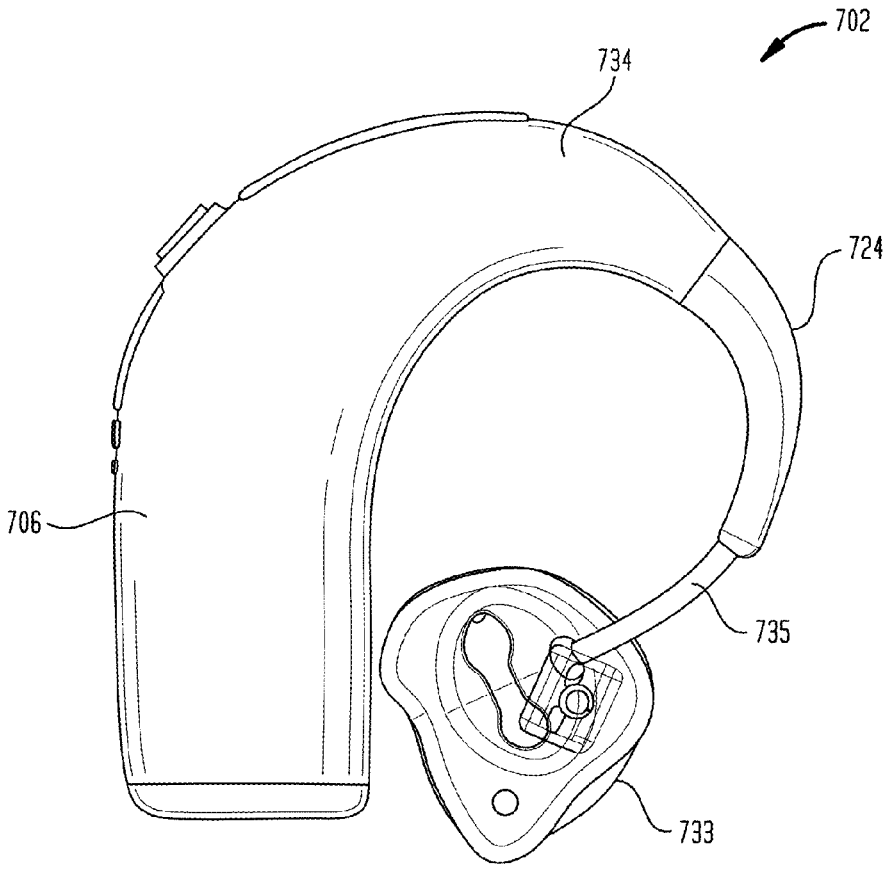
FIG. 13A is a side view of an external component of an hybrid hearing device for use with a protective sleeve in accordance with embodiments presented herein.

FIG. 13A illustrates a portion of another hearing prosthesis for use with a protective sleeve in accordance with embodiments presented herein may be used. More specifically, FIG. 13A is a side view of a portion of an external component 702 of a hybrid hearing device. A hybrid hearing device includes elements of a cochlear implant (as described above with reference to FIG. 1A) and an acoustic hearing aid. Although substantially similar to implantable component 144 of FIG. 1A, the implantable portion of a hybrid hearing device includes a different stimulating assembly than that used in conventional cochlear implants. In particular, the hybrid hearing device includes a shortened stimulating assembly implanted in a recipient's cochlea that is designed to stimulate high and mid frequency portions of the cochlea, while preserving the hearing of lower frequency portions of the cochlea. A hybrid hearing device also includes an acoustic receiver, such as an RITE receiver and a sound processor. The sound processor is configured to process received sound signals and provide both signals for use in both electric and acoustic stimulation.

Shown in FIG. 13A is a behind-the-ear sound processor 734 and receiver 733 of the external component 742. The behind-the-ear sound processor 734 includes a substantially hard housing 706. One or more sound input elements, such as microphones, telecoils, etc. for detecting sound are disposed in (or on) the housing 706. A power source (not shown) and sound processing elements (also not shown) are also disposed in the housing 706. The sound processing elements process electrical signals generated by the sound input element(s) and provide the processed signals to an external coil (not shown) in an external coil assembly (also not shown).

The receiver 733 is, in essence, equivalent to a small speaker. The receiver 733 is placed in the ear, but the electronics (i.e., sound input elements, sound processing elements, power source, etc.) are hidden behind the ear in the sound processor 634. As shown in FIG. 13A, the receiver 733 is physically and electrically connected to the sound processor 734 via a wire/tube 735 and an ear hook 724. In certain embodiments, the wire 735 is a thin and clear wire that is substantially invisible.

The ear hook 724 is a rigid member that is configured to attach the behind-the-ear sound processor 734 to the recipient's ear. That is, while in use, the ear hook 724 hangs on the top of the recipient's outer ear such that the sound processor 734 lies substantially behind the recipient's outer ear.

Although not shown in FIG. 13A, the external component 702 also comprises an external coil assembly. The external coil assembly may be similar to the external coil assembly 121 shown in FIGS. 1B and 1C.

Figure 13B:
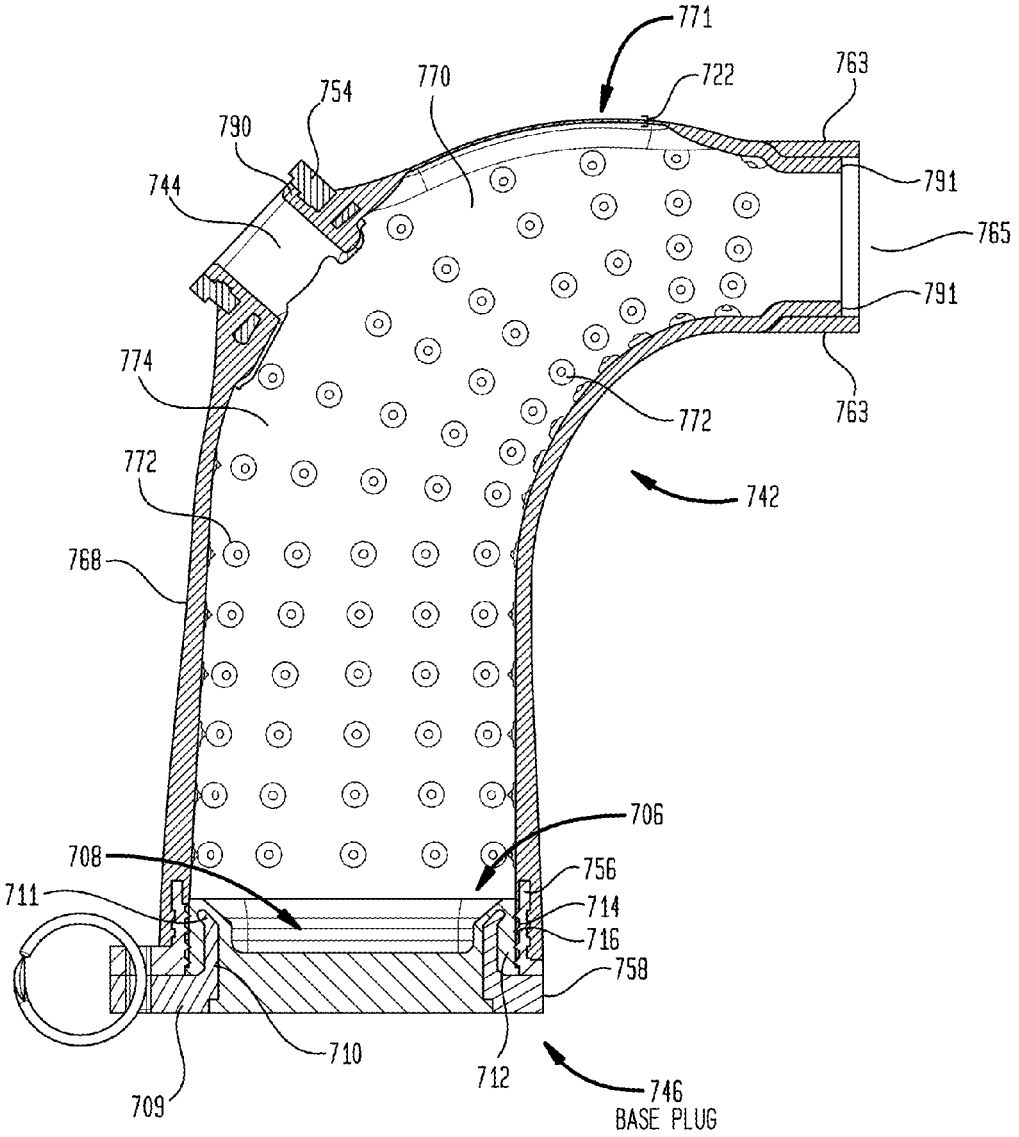
FIG. 13B is a cross-sectional view of a protective sleeve in accordance with embodiments present herein for use with the hybrid hearing device of FIG. 13A.

FIG. 13B is a cross-sectional view of a protective sleeve 740 in accordance with embodiments present in which the behind-the-ear sound processor 734 of the hybrid hearing device may be positioned. For ease of illustration, the sound processor 734 is omitted from FIG. 13B.

In general, the protective sleeve 740 is primarily formed from a substantially flexible material that is form fitting to the behind-the-ear sound processor 734. The substantially flexible material is integrated with discrete rigid members. The rigid members interact with one another and the flexible material to substantially prevent the ingress of water, dust, and other contaminants that could potentially damage the electrical elements of the sound processor 734. Protective sleeve 740 is also configured to enable the sound processor 734 to continue operation while the sound processor is positioned in the protective sleeve.

As shown in FIG. 13B, the protective sleeve 740 comprises a main body 742 that includes a base opening 706, an ear hook port 765, and a plug port 744. The base opening 706 is configured to be substantially closed by a base plug 746. That is, the protective sleeve 740 comprises a base plug 746 that is configured to mate with the main body 742 to seal the base opening 706. The main body 742 and base plug 746 collectively form a flexible shell.

The main body 742 and base plug 746 are primarily formed from a substantially flexible and contaminant-proof (e.g., waterproof, dust proof, etc.) material. In certain embodiments, the substantially flexible material is LSR. As described further below, the substantially flexible material comprises the overall shell for the protective sleeve 740, but also operates as the sealing elements. In other words, the contaminant proof seals of the protective sleeve 740 are formed by the flexible material reinforced with rigid (e.g., hard plastic) members.

The flexible material used to form main body 742 and base plug 746 may have a Shore A hardness of approximately 40 (40 Shore A). It is appreciated that other similar materials and hardness (e.g., in the range between Shore 20A and 60A) may be used in alternative embodiments.

The main body 742 is integrated with (e.g., molded over and/or around) a plurality of substantially rigid members 754, 756 and 763. Similarly, the base plug 746 is integrated with a substantially rigid member 758. As described further below, the substantially rigid members 754, 756, 763, and 758 interact with the flexible material of the main body 742 and/or base plug 746 to seal the behind-the-ear sound processor 734 in the sleeve in a manner that prevents the ingress of water, dust, and other contaminants that could potentially damage the electrical elements of the behind-the-ear sound processor 734.

The material forming the rigid members 754, 756, 758, and 763 is substantially harder than the flexible material forming the main body 742 and base plug 746. For example, in certain embodiments the rigid members 754, 756, 758, and 763 have a Shore D hardness of 80. It is appreciated that other similar materials and hardness (e.g., in the range between Rockwell R 50 and Rockwell R 120) may be used in alternative embodiments.

In certain embodiments, the main body 742, base plug 746, rigid member 754, rigid member 756, and rigid member 763 may be formed from substantially clear (transparent) materials, while the rigid member 758 is formed from an opaque rigid material. In other embodiments, main body 742 and base plug 746 may be formed from a substantially clear flexible material, while the rigid members 754, 756, 758, and 764 are formed from opaque rigid materials. It is to be appreciated that other combinations of clear, opaque, or other colors are also possible in different embodiments.

The main body 742 is configured to be substantially form (close) fitting to the behind-the-ear sound processor 734. The close fitting between the main body 742 and the behind-the-ear sound processor 734 may be considered aesthetically pleasing since it adds minimal bulk to the behind-the-ear sound processor 734, thereby improving retention and reducing irritation for the receipt, as compared to traditional arrangements. Furthermore, since the protective sleeve 740 is as streamlined as possible, there is minimal surface area for water or other contaminants to strike while, for example, swimming. This minimal surface area improves retention during such activities.

In certain embodiments, the exterior/outer surface 768 of the main body 742 is designed to have a polished finish. The polished finished improves the clarity and transparency of the flexible material so that a recipient or other user can see through to the inside of the protective sleeve 740. Additionally, a high polish finish results in an exterior surface 768 that, relative to an unpolished surface, is relatively easier for a recipient or other user to grip. An exterior surface 768 that is easy to grip makes it easier for the recipient to handle the protective sleeve 740 during installation and removal of the behind-the-ear sound processor 734, as well as during general use. In further embodiments, a polished finish on the outer surface 768 may result in a product that has increased friction with the recipient's skin, thereby creating a "sticking" effect that results in improved retention of the protective sleeve 740 and the behind-the-ear sound processor 734 when worn by a recipient.

Also as shown in FIG. 13B, the inner surface 770 of the main body 742 has a plurality of protruding dimples 772 and areas 774 between the dimples. The dimples 772 and/or the areas 774 are textured/roughened surfaces. For example, the dimples 772 and areas 774 may be textured to a specific EDM finish. In one specific example, the dimples 772 and areas 774 have an EDM finish of VDI CH 36. In operation, the textured surface areas 774 and the dimples 772 make it easier to install and remove the behind-the-ear sound processor 734. Without these features, the behind-the-ear sound processor 734 would be very difficult to install and remove, due to the form fitting shape/design and the inherent "stickiness" of the flexible material forming main body 742. The dimples 772 may also provide an aesthetic benefit, giving the appearance of water droplets when viewed from the outside of the protective sleeve 740.

As noted above, the hybrid hearing device is configured to continue operation while the sound processor 734 is positioned in the protective sleeve 740. The hybrid hearing device operates by receiving sound signals at the sound input elements in/on the sound processor 734 that convert the sound signals into electrical signals. These electrical signals are processed by the sound processing elements in the sound processor 734. Some of the processed electrical signals are provided to the receiver 733 positioned in the user's ear via the ear hook 724 and wire 735. Other processed electrical signals are provided to the internal components via the external coil assembly. Therefore, to continue operation while in the protective sleeve 740, the sound processor 734 needs to be physically and electrically connected to both the ear hook 724 and the external coil assembly. To enable such connection, the protective sleeve 740 includes an ear hook port 765 and a cable port plug 744.

The ear hook port 765 is configured to receive an ear hook plug that is substantially similar to the ear hook plug 567 of FIG. 12C. The ear hook plug 767 is an aperture that is surrounded by a portion 791 of the flexible material forming main body 742. The flexible material surrounding ear hook port 765 is referred to herein as flexible portion 791. Disposed around the flexible portion 791 is the substantially rigid member 754. The substantially rigid member 754 is a rigid port ring that provides structural support for the ear hook port 765 and, as described further below, allows sealing to occur when the ear hook plug 767 is inserted into the ear hook port 765.

As described above with reference to FIG. 12C, the ear hook plug 567 includes an electrical connector 595 that electrically connects to an electrical connector of the behind-the-ear sound processor 534. The electrical connector 795 is surrounded by a rigid member 597. The outer surface of the rigid member 597 is corrugated so as to include a plurality of ridges/ribs 602 that define a plurality of grooves/troughs 604 extending around the circumference of the rigid member. The rigid member is sized such that when inserted into the ear hook port 765, the corrugated surface causes deformation of the flexible portion 791 that creates a contaminant-proof seal around ear hook port 765. More specifically, the ridges 502 compress the softer flexible portion 791 against the rigid port ring 763 such that sections of the flexible portion will deform into grooves 604. As such, rather than having discrete compressible components such as O-rings or soft flanges on a substantially hard body as in conventional arrangements, the protective sleeve 740 uses compressible material that is integrated with (i.e., forming part of) the main body 742 to seal the ear hook port 765. In other words, the flexible material forming body 742 provides the dual function of enclosing the behind-the-ear sound processor 734 and operating as a compressible contaminant-proof seal.

The plug port 744 is configured to receive a cable plug similar to the cable plug 292 shown in FIG. 6C. The plug port 744 is an aperture that is surrounded by a portion 790 of the flexible material forming main body 742. The flexible material surrounding plug port 744 is referred to herein as flexible portion 790. Disposed around the flexible portion 790 is the substantially rigid member 754. The substantially rigid member 754 is a rigid port ring that provides structural support for the plug port 744 and, as described further below, allows sealing to occur when a coil cable plug is inserted into the plug port 744.

As noted above with reference to FIG. 6C, the cable plug 292 includes an electrical connector 294 that electrically connects to an electrical connector of the behind-the-ear sound processor 734. The electrical connector 294 is surrounded by a rigid member 298. The outer surface of the rigid member 298 is corrugated so as to include a plurality of ridges/ribs 300 that define a plurality of grooves/troughs 302 extending around the circumference of the rigid member. The rigid member 298 is sized such that when inserted into the plug port 244, the corrugated surface causes deformation of the flexible portion 790 that creates a contaminant-proof seal around the plug port 744. More specifically, the ridges 300 compress the softer flexible portion 790 against the rigid port ring 754 such that sections of the flexible portion will deform into grooves 302. As such, rather than having discrete compressible components such as O-rings or soft flanges on a substantially hard body as in conventional arrangements, the protective sleeve 740 uses compressible material that is integrated with (i.e., forming part of) the main body 742 to seal the plug port 744. In other words, the flexible material forming body 742 provides the dual function of enclosing the behind-the-ear sound processor 734 and operating as a compressible contaminant-proof seal.

As noted above, the main body 742 includes a base opening 706 that is closed/sealed by a base plug 746. The base opening 706 is surrounded by the rigid member 756. As shown, the rigid member 756 is a rigid base ring extending around the outer edge of the base opening. The main body 742 is molded around the rigid base ring 756.

The base plug 746 comprises a top opening 708 that is surrounded by the rigid member 758. The rigid member 758 comprises a lower ring platform 709 integrated with a rigid plug ring 710. The plug ring 710 extends from the lower platform 709 around the top opening 708. The plug ring 710 terminates in a rigid protrusion 712. The substantially flexible material (e.g., LSR) surrounds the plug ring 710. The portion of the flexible material surrounding the plug ring 710 is referred to herein as flexible member 712. Flexible member 712 is corrugated so as to include a plurality of ridges/ribs 714 that define a plurality of troughs/grooves 716 that are adjacent to the outer surface of plug ring 710.

In certain embodiments, the flexible member 712 may substantially fill the area inside the lower ring platform 709 and the plug ring 710 to form a bottom seal for the protective sleeve 740. In other words, flexible member 712 fills the opening 708. In other embodiments, the lower ring platform 709 is configured as a planar element that forms the bottom seal (i.e., instead of a ring, the bottom of the rigid member 758 is a planar surface).

When the base plug 746 is inserted into the base opening 706, the flexible member 712 will be compressed by the rigid ring 756 and the rigid member 758. The compression of the soft corrugations (i.e., ridges 714 and troughs 716) of the base plug 746 against the smooth hard part 756 creates a contaminant-proof (e.g., waterproof, dustproof, etc.) seal. That is, the low profile flexible member 712 is compressed/deformed (not deflected) when pushed into the main body 742, thereby creating the lower seal of the protective sleeve 740.

When the behind-the-ear sound processor 734 is inserted into the protective sleeve 240, the microphones of the behind-the-ear sound processor 734 are located adjacent to an upper portion 771 of the main body 742. Therefore, the main body 242 has a cross-section 722 that is thinner that the cross-section of the rest of the main body 742. That is, the upper portion 771 of the main body 742 is locally thinned to create a relatively thin membrane which allows uninterrupted sound transmission from outside the protective sleeve 740 to the microphones. In certain embodiments, the upper portion 771 may have a thinned cross-section 722 in the range of, for example, approximately 0.1 mm to approximately 0.5 mm. In certain embodiments, the remainder of main body 742 outside of the upper portion 771 may have a cross-section of approximately 1 mm.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A protective sleeve for a hearing prosthesis sound processor, comprising:

a shell formed from a substantially flexible material;

a plug port in the shell that is surrounded by a portion of the substantially flexible material; and a substantially rigid port ring disposed around the portion of the substantially flexible material surrounding the plug port, wherein when a plug is inserted into the plug port, the port ring operates with the plug to deform the portion of the substantially flexible material surrounding the plug port to seal the plug in the shell.

2. The protective sleeve of claim 1, wherein the shell comprises:

a main body formed from the flexible material having the rigid port ring integrated therein; and a base plug formed from the substantially flexible material and configured to be inserted into a base opening of the main body to seal the sound processor in the main body.

3. The protective sleeve of claim 2, wherein the main body includes a substantially rigid base ring surrounding the base opening, and wherein the base plug comprises a substantially rigid plug ring surrounded by a portion of the substantially flexible material such that when the base plug is inserted into the main body, the base ring operates with the plug ring to deform the portion of substantially flexible material surrounding the plug ring to seal the base plug to the main body.

4. The protective sleeve of claim 1, wherein the shell comprises:

a substantially rigid ear hook integrated with the shell.

5. The protective sleeve of claim 1, wherein the shell is shaped so as to be substantially form fitting to a behind-the-ear sound processor.

6. The protective sleeve of claim 1, wherein an inner surface of the main body includes a plurality of dimples.

7. The protective sleeve of claim 6, wherein the plurality of dimples and areas of the inner surface of the main body between the plurality of dimples are textured.

8. A protective sleeve for a behind-the-ear sound processor of a hearing prosthesis, comprising:

a main body formed from a substantially flexible material having a base opening configured to receive the behind-the-ear sound processor;

a substantially rigid ear hook integrated with the main body; and a base plug formed from the substantially flexible material and configured to be inserted into the base opening to seal the behind-the-ear sound processor in the main body, wherein an inner surface of the main body includes a plurality of dimples.

9. The protective sleeve of claim 8, wherein the main body includes a substantially rigid base ring surrounding the base opening, and wherein the base plug comprises a substantially rigid plug ring surrounded by a portion of the substantially flexible material such that when the base plug is inserted into the main body, the base ring operates with the plug ring to deform the portion of substantially flexible material surrounding the plug ring to seal the base plug to the main body.

10. The protective sleeve of claim 8, wherein the main body comprises:

a plug port surrounded by a portion of the substantially flexible material; and a substantially rigid port ring disposed around the portion of the substantially flexible material surrounding the plug port, wherein when a plug is inserted into the plug port, the port ring operates with the plug to deform the portion of the substantially flexible material surrounding the plug port to seal the plug in the main body.

11. The protective sleeve of claim 8, wherein the main body is shaped so as to be substantially form fitting to the behind-the-ear sound processor.

12. The protective sleeve of claim 8, wherein the plurality of dimples and areas of the inner surface of the main body between the plurality of dimples are textured.

13. A protective sleeve for a hearing prosthesis sound processor, comprising:

a substantially flexible main body having a base opening and integrated with a rigid base ring disposed around the base opening; and a substantially flexible base plug integrated with a rigid plug ring and configured to be inserted into the base opening, wherein when the base plug is inserted into the base opening, the rigid plug ring operates with the rigid base ring to compress one or more of the main body or the base plug to seal the sound processor in the protective sleeve.

14. The protective sleeve of claim 13, wherein the main body includes an elongate first section shaped to receive a behind-the-ear sound processor.

15. The protective sleeve of claim 14, wherein the first elongate section is shaped so as to be substantially form fitting to the behind-the-ear sound processor.

16. The protective sleeve of claim 14, wherein the main body further includes a second section in which a substantially rigid ear hook is permanently disposed.

17. The protective sleeve of claim 13, wherein the main body and base plug comprise first and second mating halves, respectively, configured to enclose a button processor.

18. The protective sleeve of claim 13, wherein the main body comprises:

a plug port surrounded by a portion of substantially flexible material forming the main body; and a substantially rigid port ring disposed around the portion of the substantially flexible material surrounding the plug port, wherein when a plug is inserted into the plug port, the port ring operates with the plug to deform the portion of the substantially flexible material surrounding the plug port to seal the plug in the main body.

19. The protective sleeve of claim 13, wherein inner surfaces of one or more of the main body and base plug include a plurality of dimples.

* * * * *